US012276271B2

(12) United States Patent
Matsumoto et al.

(10) Patent No.: US 12,276,271 B2
(45) Date of Patent: Apr. 15, 2025

(54) FLUID CONTROL DEVICE

(71) Applicant: Murata Manufacturing Co., Ltd., Kyoto (JP)

(72) Inventors: Shinichiro Matsumoto, Kyoto (JP); Masahiro Sasaki, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 130 days.

(21) Appl. No.: 17/659,673

(22) Filed: Apr. 19, 2022

(65) Prior Publication Data

US 2022/0235761 A1 Jul. 28, 2022

Related U.S. Application Data

(63) Continuation of application No. PCT/JP2020/033358, filed on Sep. 3, 2020.

(30) Foreign Application Priority Data

Oct. 21, 2019 (JP) ..... 2019-191636

(51) Int. Cl.
*F04B 43/04* (2006.01)
*F04B 17/00* (2006.01)
(Continued)

(52) U.S. Cl.
CPC ..... *F04B 43/046* (2013.01); *F04B 17/003* (2013.01); *F04B 19/006* (2013.01);
(Continued)

(58) Field of Classification Search
CPC .... F04B 43/046; F04B 41/06; F04B 43/0072; F04B 43/043; F04B 43/088; F04B 17/003;
(Continued)

(56) References Cited

U.S. PATENT DOCUMENTS 3,586,461 A * 6/1971 Erlandson ..... F04F 1/16 417/246
6,179,586 B1 1/2001 Herb et al.
(Continued)

FOREIGN PATENT DOCUMENTS

CN 101244371 A 8/2008
CN 103705992 A 4/2014
(Continued)

OTHER PUBLICATIONS

International Search Report for International Patent Application No. PCT/JP2020/033358 dated Nov. 10, 2020.

*Primary Examiner* — Peter J Bertheaud
(74) *Attorney, Agent, or Firm* — McDonald Hopkins LLC

(57) ABSTRACT

A fluid control device includes piezoelectric pumps and a substrate. The substrate includes dielectric base members. Each of the dielectric base members has a recess and a through-hole. Each of the dielectric base members is laminated such that the recesses of the dielectric base members partially overlap and communicate with each other. A portion of the recesses not overlapping with the dielectric base member serve as a first opening and a second opening, respectively, to the outside. The first opening and the second opening open in opposite directions in the lamination direction. The first opening and the second opening have shapes that may be fit to each other. The piezoelectric pump is on the dielectric base member to communicate with the through-hole, and the piezoelectric pump is on the dielectric base member to communicate with the through-hole.

19 Claims, 17 Drawing Sheets

(51) Int. Cl.

| | |
|---|---|
| ***F04B 19/00*** | (2006.01) |
| ***F04B 23/04*** | (2006.01) |
| ***F04B 41/06*** | (2006.01) |
| ***F04B 43/00*** | (2006.01) |
| ***F04B 43/08*** | (2006.01) |
| ***F04B 53/16*** | (2006.01) |
| ***F04B 53/22*** | (2006.01) |

(52) U.S. Cl.
CPC ..... *F04B 23/04* (2013.01); *F04B 41/06* (2013.01); *F04B 43/0072* (2013.01); *F04B 43/043* (2013.01); *F04B 43/088* (2013.01); *F04B 53/16* (2013.01); *F04B 53/22* (2013.01)

(58) Field of Classification Search
CPC ..... F04B 19/006; F04B 23/04; F04B 53/16; F04B 53/22
See application file for complete search history.

(56) References Cited

U.S. PATENT DOCUMENTS

| | | | |
|---|---|---|---|
| 2005/0095143 | A1 | 5/2005 | Bernard et al. |
| 2012/0171062 | A1 | 7/2012 | Kodama et al. |
| 2014/0094727 | A1 | 4/2014 | Deshpande et al. |
| 2015/0247580 | A1 | 9/2015 | Au et al. |
| 2015/0267695 | A1 | 9/2015 | Marsh |
| 2019/0145396 | A1 | 5/2019 | Marsh |

FOREIGN PATENT DOCUMENTS

| | | | |
|---|---|---|---|
| DE | 60033410 | T2 | 10/2007 |
| JP | 2000-104659 | A | 4/2000 |
| JP | 2017-002909 | A | 1/2017 |
| JP | 2017-506722 | A | 3/2017 |
| WO | 2011/145544 | A1 | 11/2011 |

* cited by examiner

FLUID CONTROL DEVICE

CROSS REFERENCE TO RELATED APPLICATION

This is a continuation of International Application No. PCT/JP2020/033358 filed on Sep. 3, 2020 which claims priority from Japanese Patent Application No. 2019-191636 filed on Oct. 21, 2019. The contents of these applications are incorporated herein by reference in their entireties.

BACKGROUND ART

Technical Field

The present disclosure relates to a fluid control device that conveys a fluid in a predetermined direction.

Patent Document 1 discloses a pump unit. The pump unit described in Patent Document 1 includes a housing and multiple micropumps.

The multiple micropumps are disposed inside the housing. The multiple micropumps are coupled in series or in parallel to a flow path formed in the housing.

Patent Document 1: Japanese Unexamined Patent Application Publication No. 2017-2909

BRIEF SUMMARY

However, in the pump unit described in Patent Document 1, a flow rate that may be achieved as a pump unit is limited depending on the number of micropumps installed in the housing. In other words, with the pump unit described in Patent Document 1, it is difficult to adjust the flow rate.

The present disclosure provides a fluid control device in which a flow rate may easily be adjusted.

A fluid control device according to the present disclosure includes a pump that conveys a fluid and a housing in which the pump is installed. The housing has a space, a communication hole, a first coupling portion, a second coupling portion, a first opening, and a second opening. The space is formed inside the housing. The communication hole allows the space inside the housing to communicate with the pump. The first coupling portion and the second coupling portion are portions for physically coupling to an external member. The first opening is formed in the first coupling portion and makes the space inside the housing open to the outside. The second opening is formed in the second coupling portion and makes the space inside the housing open to the outside. The first coupling portion and the second coupling portion have outer shapes that may be fit to each other such that when a housing is coupled to another housing, the two housings communicate with each other through the first opening of the housing and the second opening of the other housing.

In this configuration, the multiple housings may easily be coupled. The coupling of the multiple housings allows the spaces inside the multiple housings to easily communicate with each other. With this, the number of pumps used for fluid control may easily be changed.

According to the present disclosure, a flow rate may easily be adjusted.

DETAILED DESCRIPTION

First Embodiment

Figure 1:
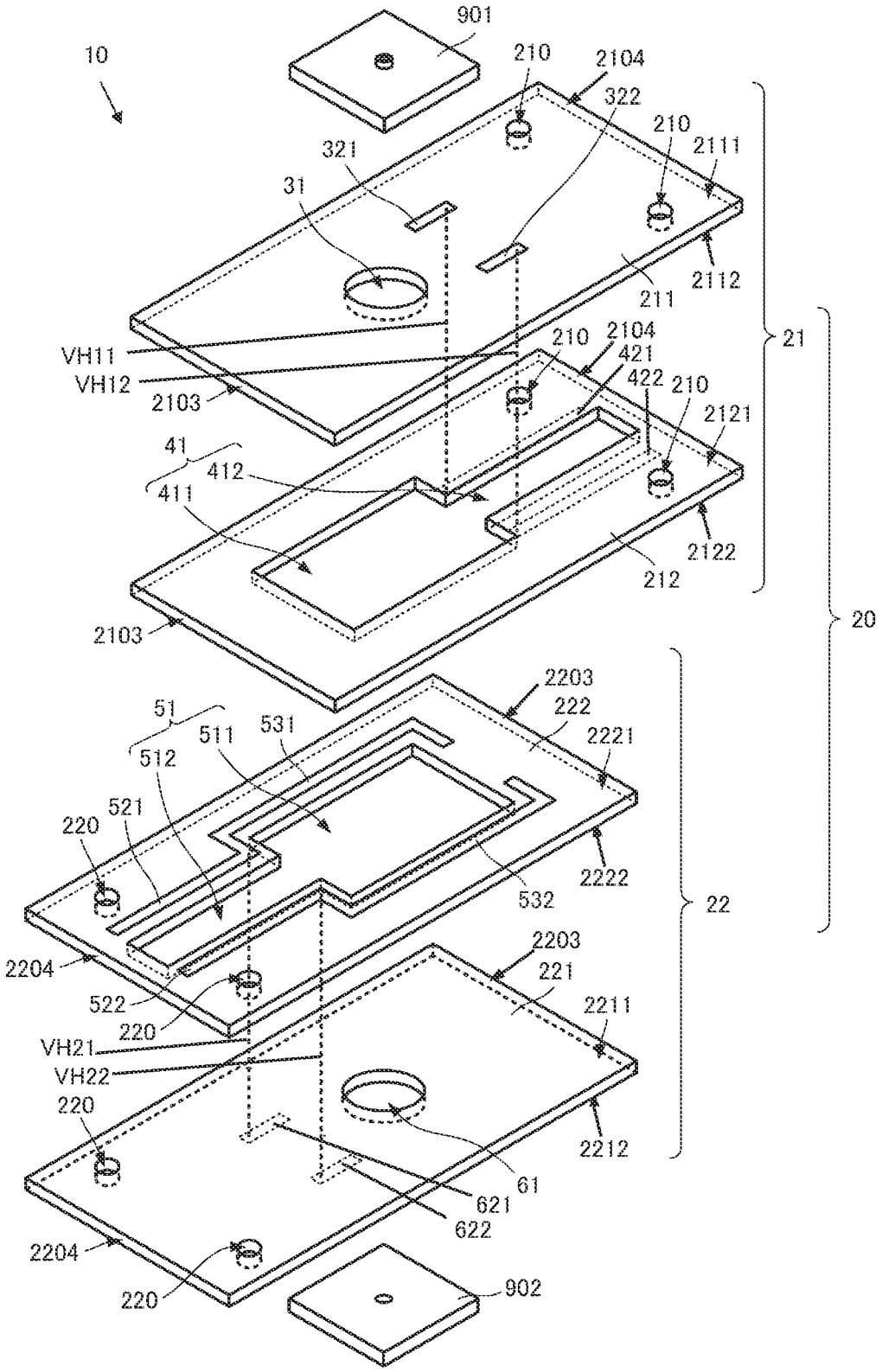
FIG. 1 is an exploded perspective view illustrating a configuration of a fluid control device according to a first embodiment.
Figure 2A:
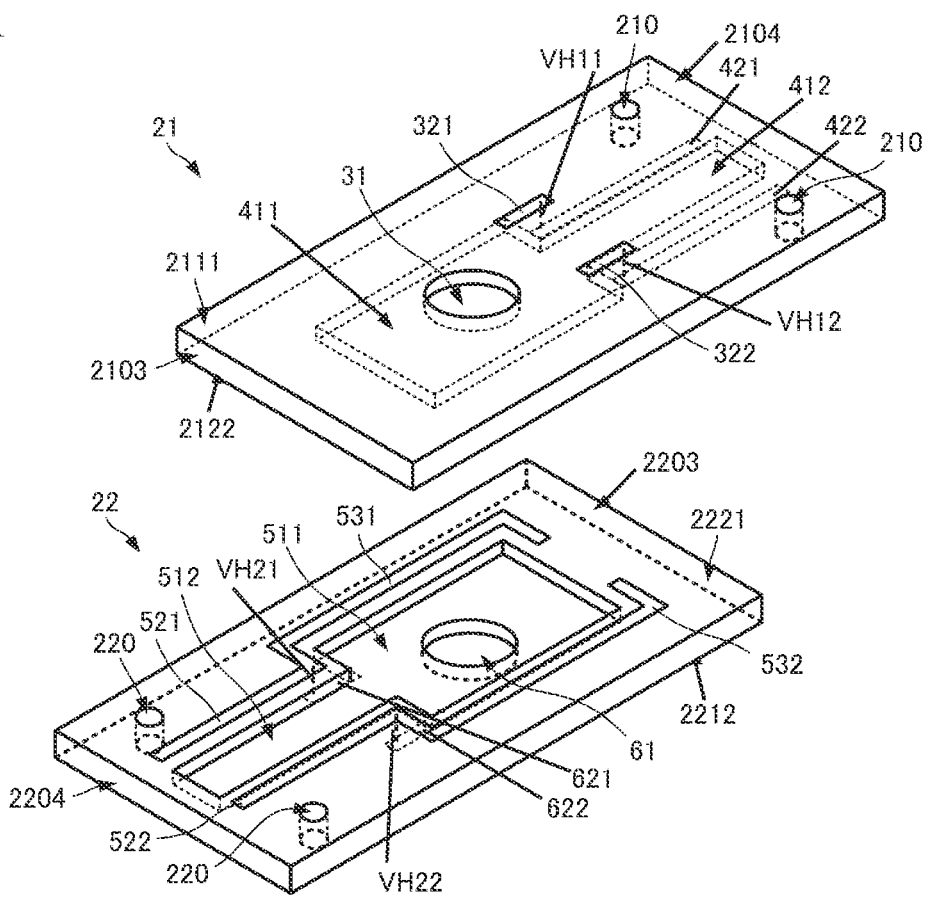
FIG. 2A is an exploded perspective view of a housing of the fluid control device according to the first embodiment.
Figure 2B:
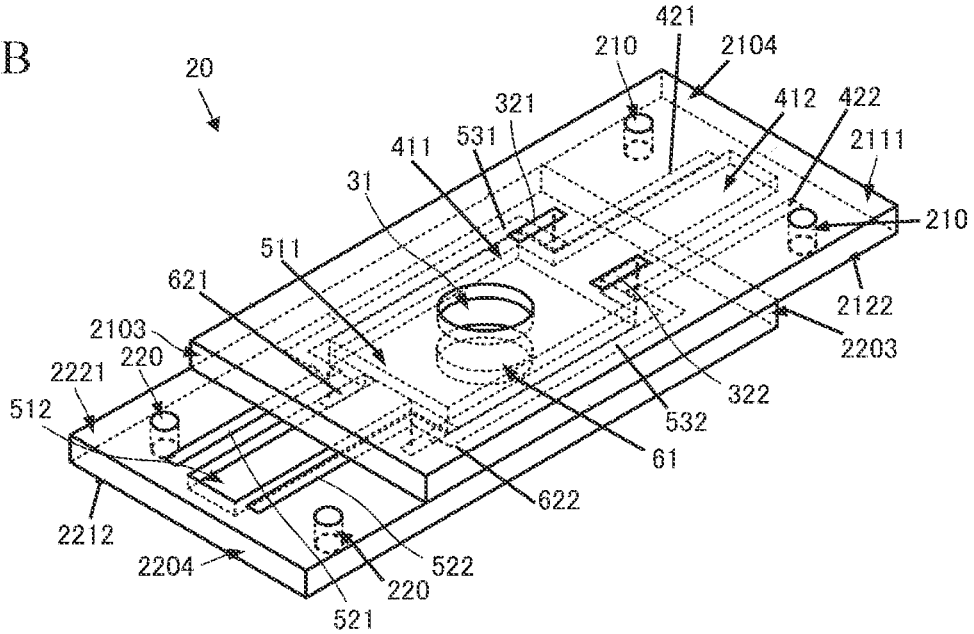
FIG. 2B is a perspective view of the housing of the fluid control device according to the first embodiment.
Figure 3:
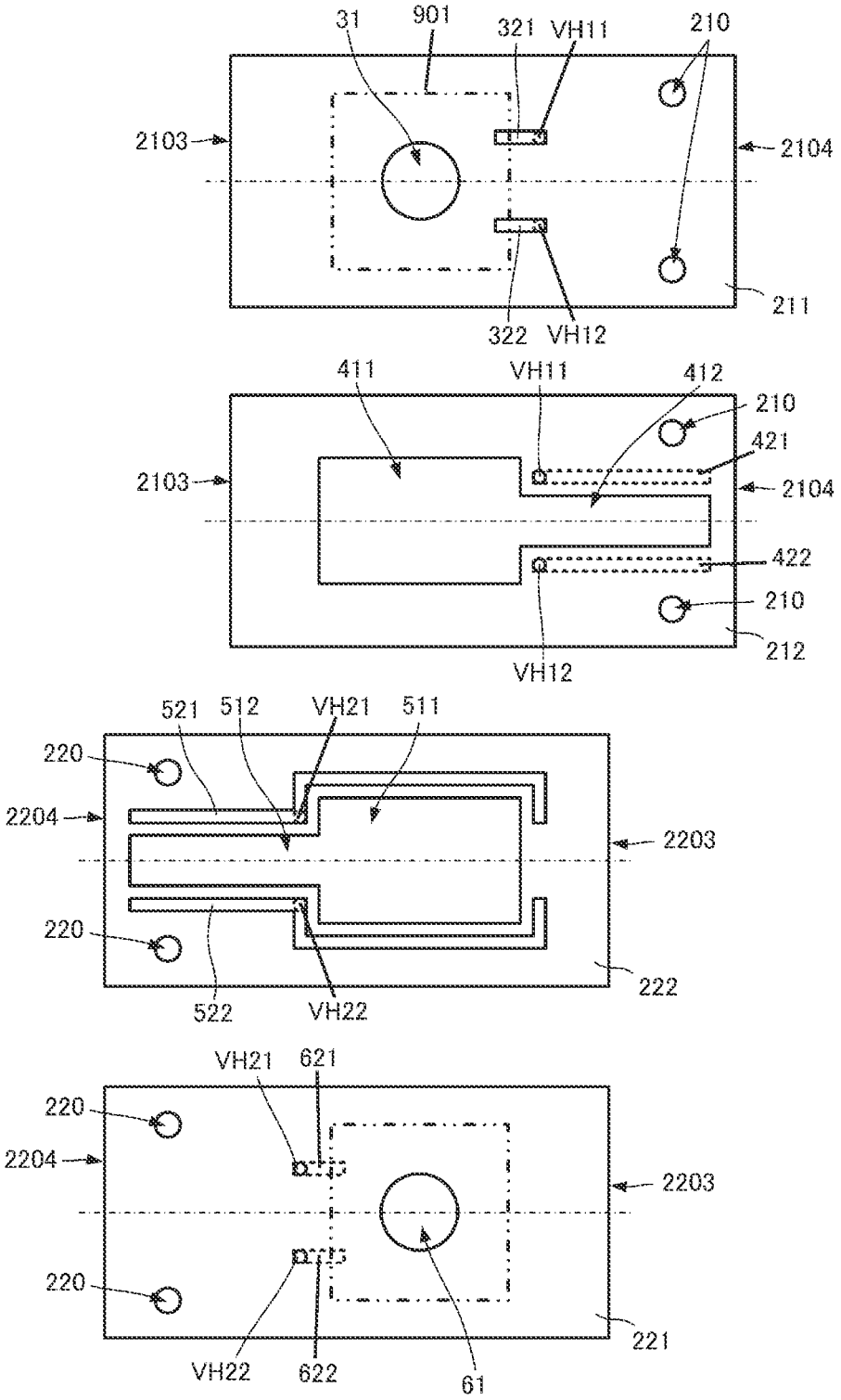
FIG. 3 is an exploded plan view of the housing of the fluid control device according to the first embodiment.
Figure 4A:
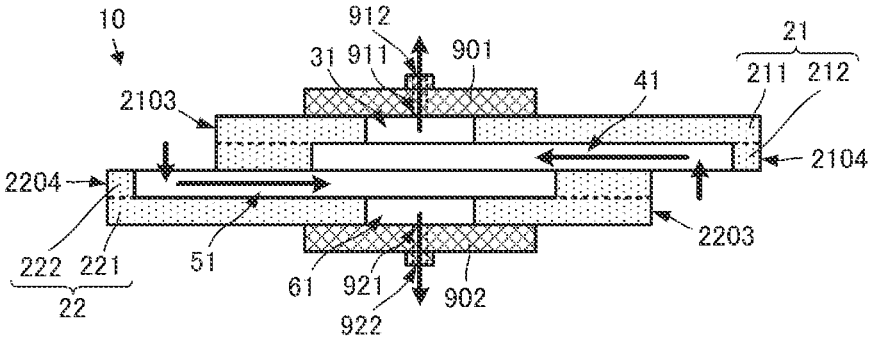
FIG. 4A and FIG. 4B are side sectional views of the fluid control device according to the first embodiment.
Figure 4B:
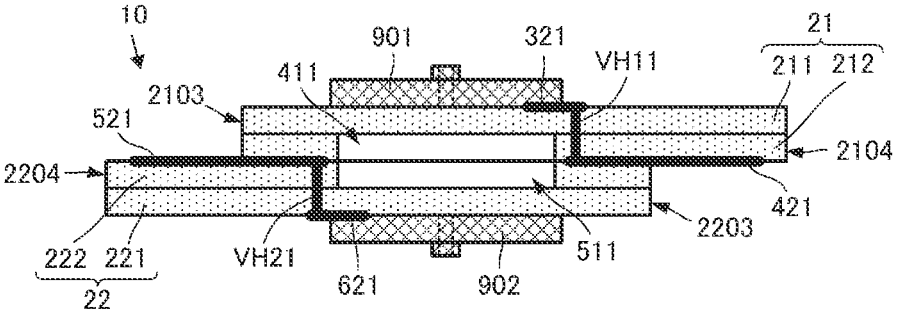

A fluid control device according to a first embodiment of the present disclosure will be described with reference to the drawings. FIG. 1 is an exploded perspective view illustrating a configuration of the fluid control device according to the first embodiment. FIG. 2A is an exploded perspective view of a housing of the fluid control device according to the first embodiment, and FIG. 2B is a perspective view of the housing of the fluid control device according to the first embodiment. FIG. 3 is an exploded plan view of the housing of the fluid control device according to the first embodiment. FIG. 4A and FIG. 4B are side sectional views of the fluid control device according to the first embodiment. FIG. 4A is a diagram facilitating the understanding of a connection of spaces, and FIG. 4B is a diagram facilitating the understanding of an electrical connection.

Configuration of Fluid Control Device 10

As illustrated in FIG. 1, a fluid control device 10 includes a substrate 20, a piezoelectric pump 901, and a piezoelectric pump 902. The substrate 20 corresponds to a "housing" of the present disclosure, the piezoelectric pump 901 corresponds to a "first pump" of the present disclosure, and the piezoelectric pump 902 corresponds to a "second pump" of the present disclosure. As will be described later, the fluid control device 10 has a structure in which the multiple fluid control devices may be used by being coupled to each other. Accordingly, the fluid control device 10 may be made to function as a fluid control device singly, whereas defining one fluid control device 10 as a unit, multiple units may be made to function as a single fluid control device.

As illustrated in FIG. 1, FIG. 2A, FIG. 2B, and FIG. 3, the substrate 20 has a dielectric layer 211, a dielectric layer 212, a dielectric layer 221, and a dielectric layer 222. The dielectric layer 211, the dielectric layer 212, the dielectric layer 221, and the dielectric layer 222 have a flat plate-shape.

The dielectric layer 211 has a main surface 2111, a main surface 2112, an end surface 2103, an end surface 2104, and two side surfaces. The dielectric layer 211 has a rectangular shape in plan view (when viewed in a direction orthogonal to the main surface 2111 and the main surface 2112).

A through-hole 31 is formed in the dielectric layer 211. A connection and fixation through-hole 210 is formed in the dielectric layer 211. The through-hole 31 and the connection and fixation through-hole 210 extend through the dielectric layer 211 in a thickness direction (direction orthogonal to the main surface 2111 and the main surface 2112). The through-hole 31 corresponds to a "first communication hole" of the present disclosure.

Linear conductor patterns 321 and 322 are formed on the main surface 2111 of the dielectric layer 211.

The dielectric layer 212 has a main surface 2121, a main surface 2122, the end surface 2103, the end surface 2104, and two side surfaces. The dielectric layer 212 has a rectangular shape in plan view (when viewed in a direction orthogonal to the main surface 2121 and the main surface 2122). The dielectric layer 212 has the same shape as the dielectric layer 211 in plan view.

A through-hole 411 and a through-hole 412 are formed in the dielectric layer 212. The connection and fixation through-hole 210 is formed in the dielectric layer 212. The through-hole 411, the through-hole 412, and the connection and fixation through-hole 210 extend through the dielectric layer 212 in the thickness direction (direction orthogonal to the main surface 2121 and the main surface 2122).

The through-hole 411 has a rectangular shape in plan view, for example. An opening area (area in plan view) of the through-hole 411 is larger than an opening area (area in plan view) of the through-hole 31 of the dielectric layer 211. Further, the through-hole 411 is formed at a position where the through-hole 31 is included in the region of the through-hole 411, in a state where the dielectric layer 212 and the dielectric layer 211 are laminated.

The through-hole 412 is disposed on the end surface 2104 side relative to the through-hole 411. The through-hole 412 has a shape extending in a longitudinal direction (direction orthogonal to the end surface 2103 and the end surface 2104). The through-hole 412 communicates with the through-hole 411.

Linear conductor patterns 421 and 422 corresponding to the first conductor pattern are formed on the main surface 2122 of the dielectric layer 212. The conductor pattern 421 and the conductor pattern 422 are disposed on the end surface 2104 side relative to the through-hole 411 and have a shape extending in the longitudinal direction.

The dielectric layer 211 and the dielectric layer 212 are laminated. In the lamination, the main surface 2112 of the dielectric layer 211 and the main surface 2121 of the dielectric layer 212 are in contact with each other over substantially the entire surface. In this way, a dielectric base member 21 is formed by a flat plate in which the dielectric layer 211 and the dielectric layer 212 are laminated. The dielectric base member 21 corresponds to a "first dielectric base member" of the present disclosure.

Because of the laminated structure of the dielectric layer 211 and the dielectric layer 212 described above, the dielectric base member 21 has a recess 41 recessed from the main surface 2122 side. The recess 41 is realized by closing one opening of the through-hole 411 and one opening of the through-hole 412 with the dielectric layer 211. The recess 41 communicates with the through-hole 31 in a region corresponding to the through-hole 411. The recess 41 corresponds to a "first recess" of the present disclosure.

The shape of the dielectric layer 221 is obtained by substantially reversing a positional relationship of the main surfaces and a positional relationship of the end surfaces in the dielectric layer 211.

The dielectric layer 221 has a main surface 2211, a main surface 2212, an end surface 2203, an end surface 2204, and two side surfaces. The dielectric layer 221 has a rectangular shape in plan view (when viewed in a direction orthogonal to the main surface 2211 and the main surface 2212).

A through-hole 61 is formed in the dielectric layer 221. A connection and fixation through-hole 220 is formed in the dielectric layer 221. The through-hole 61 and the connection and fixation through-hole 220 extend through the dielectric layer 221 in the thickness direction (direction orthogonal to the main surface 2211 and the main surface 2212). The through-hole 61 corresponds to a "second communication hole" of the present disclosure.

Linear conductor patterns 621 and 622 are formed on the main surface 2212 of the dielectric layer 221.

The shape of the dielectric layer 222 is obtained by substantially reversing the positional relationship of the main surfaces and the positional relationship of the end surfaces in the dielectric layer 212 and adding a conductor pattern 531 and a conductor pattern 532.

The dielectric layer 222 has a main surface 2221, a main surface 2222, the end surface 2203, the end surface 2204, and two side surfaces. The dielectric layer 222 has a rectangular shape in plan view (when viewed in a direction orthogonal to the main surface 2221 and the main surface 2222). The dielectric layer 222 has the same shape as the dielectric layer 221 in plan view.

A through-hole 511 and a through-hole 512 are formed in the dielectric layer 222. The connection and fixation through-hole 220 is formed in the dielectric layer 222. The through-hole 511, the through-hole 512, and the connection and fixation through-hole 220 extend through the dielectric layer 222 in the thickness direction (direction orthogonal to the main surface 2221 and the main surface 2222).

The through-hole 511 has a rectangular shape in plan view, for example. An opening area (area in plan view) of the through-hole 511 is larger than an opening area (area in plan view) of the through-hole 61 of the dielectric layer 221. Further, the through-hole 511 is formed at a position where the through-hole 61 is included in the region of the through-hole 511, in a state where the dielectric layer 222 and the dielectric layer 221 are laminated.

The through-hole 512 is disposed on the end surface 2204 side relative to the through-hole 511. The through-hole 512 has a shape extending in the longitudinal direction (direction orthogonal to the end surface 2203 and the end surface 2204). The through-hole 512 communicates with the through-hole 511.

Linear conductor patterns 521, 522, 531, and 532 are formed on the main surface 2221 of the dielectric layer 222. The conductor patterns 521 and 522 corresponding to the second conductor pattern are disposed in the end surface 2204 side relative to the through-hole 511 and have a shape extending in the longitudinal direction. The conductor patterns 531 and 532 are formed along an outer periphery of the through-hole 511, for example. One end of the conductor pattern 531 is connected to the conductor pattern 521, and the other end thereof reaches the side opposite to the conductor pattern 521 with the through-hole 511 interposed therebetween. One end of the conductor pattern 532 is connected to the conductor pattern 522, and the other end thereof reaches the side opposite to the conductor pattern 522 with the through-hole 511 interposed therebetween.

The dielectric layer 221 and the dielectric layer 222 are laminated. In the lamination, the main surface 2211 of the dielectric layer 221 and the main surface 2222 of the dielectric layer 222 are in contact with each other over substantially the entire surface. In this way, a dielectric base member 22 is formed by a flat plate in which the dielectric layer 221 and the dielectric layer 222 are laminated. The dielectric base member 22 corresponds to a "second dielectric base member" of the present disclosure. The first dielectric base member 21 and the second dielectric base member 22 have substantially the same shape. The same shape means that the difference of the length and the width of the first dielectric base member 21 and the length and the width of the second dielectric base member 22 is between 0 mm to 10 mm, respectively, when viewed in a direction perpendicular to the main surface 2111.

Because of the laminated structure of the dielectric layer 221 and the dielectric layer 222 described above, the dielectric base member 22 has a recess 51 recessed from the main surface 2221 side. The recess 51 is realized by closing one opening of the through-hole 511 and one opening of the through-hole 512 with the dielectric layer 221. The recess 51 communicates with the through-hole 61 in a region corresponding to the through-hole 511. The recess 51 corresponds to a "second recess" of the present disclosure.

The dielectric base member 21 and the dielectric base member 22 are laminated in a state in which the main surface 2122 of the dielectric layer 212 and the main surface 2221 of the dielectric layer 222 partially overlap and are in contact with each other. In other words, the dielectric base member 21 and the dielectric base member 22 are laminated in a state where the positions thereof are shifted in the longitudinal direction. The substrate 20 is realized with a laminated substrate of the dielectric base member 21 and the dielectric base member 22.

More specifically, the dielectric base member 21 and the dielectric base member 22 are disposed such that the region of the through-hole 411 in the recess 41 and the region of the through-hole 511 in the recess 51 overlap with each other. At this time, the dielectric base member 21 and the dielectric base member 22 are laminated such that the region of the through-hole 412 in the recess 41 and the region of the through-hole 512 in the recess 51 are disposed with the region where the through-hole 411 and the through-hole 511 overlap with each other interposed therebetween.

In this configuration, as illustrated in FIG. 2A, FIG. 2B, FIG. 4A, and FIG. 4B, the end surface 2103 of the dielectric base member 21 is positioned toward the through-hole 511 in the recess 51 relative to the end surface 2204 of the dielectric base member 22. Further, the end surface 2203 of the dielectric base member 22 is positioned toward the through-hole 411 in the recess 41 relative to the end surface 2104 of the dielectric base member 21.

With this, a portion of the through-hole 412 opposite from the side communicating with the through-hole 411 is not covered with the dielectric base member 22 and is open to the outside. This opening corresponds to a "first opening" of the present disclosure. Further, a portion of the through-hole 512 opposite from the side communicating with the through-hole 511 is not covered with the dielectric base member 21 and is open to the outside. This opening corresponds to a "second opening" of the present disclosure.

With the configuration above, as illustrated in FIG. 4A, the fluid control device 10 has a flow path space (corresponding to a "space" of the present disclosure) formed of the recess 41 and the recess 51, inside the substrate 20 in which the dielectric base member 21 and the dielectric base member 22 are laminated. The flow path space communicates with an external space through a portion (second region) where the through-hole 412 in the recess 41 opens to the outside of the substrate 20. Further, the flow path space communicates with an external space through a portion (first region) where the through-hole 512 in the recess 51 opens to the outside of the substrate 20.

Further, as illustrated in FIG. 1 and FIG. 4A, the flow path space communicates with an external space through the through-hole 31 from the surface (main surface 2111) of the dielectric base member 21 opposite from the surface in contact with the dielectric base member 22. The flow path space communicates with an external space through the through-hole 61 from the surface (main surface 2212) of the dielectric base member 22 opposite from the surface in contact with the dielectric base member 21.

The piezoelectric pump 901 is disposed on the surface (main surface 2111) of the dielectric base member 21 opposite from the surface in contact with the dielectric base member 22. The piezoelectric pump 901 is disposed at a position that closes the through-hole 31. The piezoelectric pump 901 has a suction port 911 that opens in the surface in contact with the dielectric base member 21. The suction port 911 of the piezoelectric pump 901 communicates with the through-hole 31. With this, the flow path space communicates with the piezoelectric pump 901. The through-hole 31 corresponds to a "communication hole" of the present disclosure.

The piezoelectric pump 902 is disposed on the surface (main surface 2212) of the dielectric base member 22 opposite from the surface in contact with the dielectric base member 21. The piezoelectric pump 902 is disposed at a position that closes the through-hole 61. The piezoelectric pump 902 has a suction port 921 that opens in the surface in contact with the dielectric base member 22. The suction port 921 of the piezoelectric pump 902 communicates with the through-hole 61. With this, the flow path space communicates with the piezoelectric pump 902.

With the above configuration, the fluid control device 10 suctions a fluid into the flow path space from the opening of the recess 41 and the opening of the recess 51 by driving the piezoelectric pump 901 and the piezoelectric pump 902. The fluid suctioned into the flow path space is conveyed in the flow path space, reaches the through-hole 31 and the through-hole 61, and is suctioned by the piezoelectric pump 901 and the piezoelectric pump 902. The fluid is discharged to the outside of the fluid control device 10 from a discharge port 912 of the piezoelectric pump 901 and a discharge port 922 of the piezoelectric pump 902. With this, the fluid control device 10 is able to convey a fluid in a specific direction.

Note that, in the fluid control device 10 described above, it is suitable to supply a drive signal to the piezoelectric pump 901 and the piezoelectric pump 902.

In the configuration described above, as illustrated in FIG. 1 and FIG. 4B, the conductor pattern 321 and the conductor pattern 322 are connected to the piezoelectric pump 901. The conductor pattern 321 is connected to the conductor pattern 421 using a via conductor VH11 formed in the dielectric base member 21. The conductor pattern 322 is connected to the conductor pattern 422 using a via conductor VH12 formed in the dielectric base member 21.

The conductor pattern 621 and the conductor pattern 622 are connected to the piezoelectric pump 902. The conductor pattern 621 is connected to the conductor pattern 521 using a via conductor VH21 formed in the dielectric base member 22. The conductor pattern 622 is connected to the conductor pattern 522 using a via conductor VH22 formed in the dielectric base member 22.

The conductor pattern 531 is connected to the conductor pattern 521, and the conductor pattern 531 overlaps and is in contact with the conductor pattern 421. The conductor pattern 532 is connected to the conductor pattern 522, and the conductor pattern 532 overlaps and is in contact with the conductor pattern 422.

The conductor pattern 421 and the conductor pattern 422 are exposed to the outside of the substrate 20 together with the opening of the through-hole 412 described above, and the conductor pattern 521 and the conductor pattern 522 are exposed to the outside of the substrate 20 together with the opening of the through-hole 512 described above.

Accordingly, the piezoelectric pump 901 and the piezoelectric pump 902 are able to be supplied with a drive signal from the outside through the respective portions of the conductor pattern 421, the conductor pattern 422, the conductor pattern 521, and the conductor pattern 522 exposed to the outside.

Coupling Mode of Fluid Control Device

The fluid control device 10 having the configuration described above may be used singly, but as described below, multiple fluid control devices coupled to each other as a whole may be used as a single fluid control device.

Figure 5:
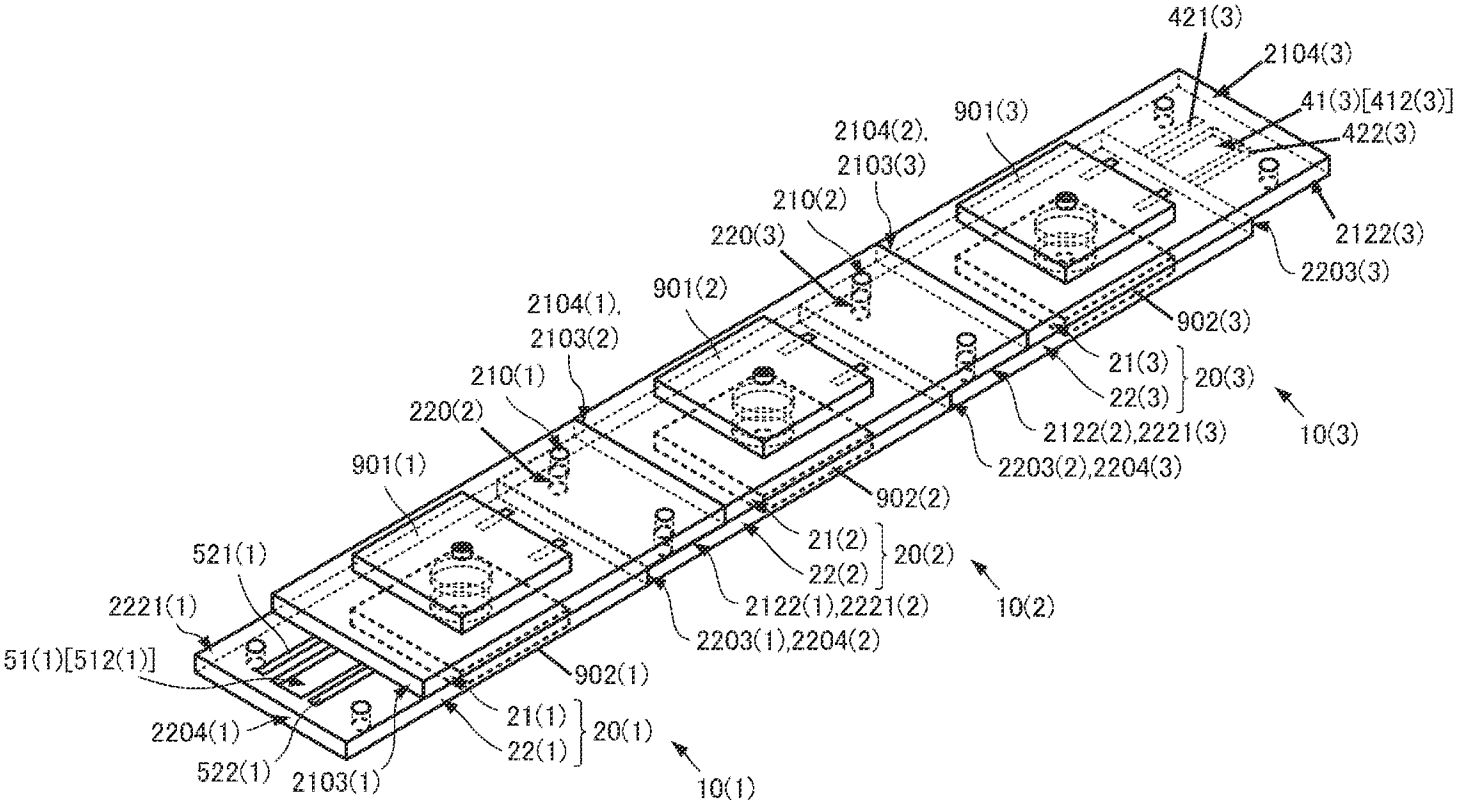
FIG. 5 is a perspective view illustrating a configuration in which multiple fluid control devices are coupled to each other.
Figure 6A:
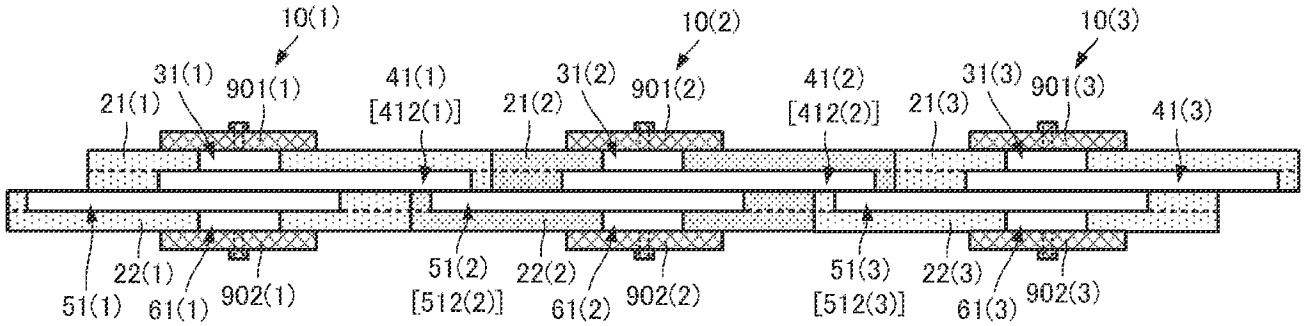
FIG. 6A is a side sectional view illustrating a connection of spaces in the configuration in which the multiple fluid control devices are coupled to each other.
Figure 6B:
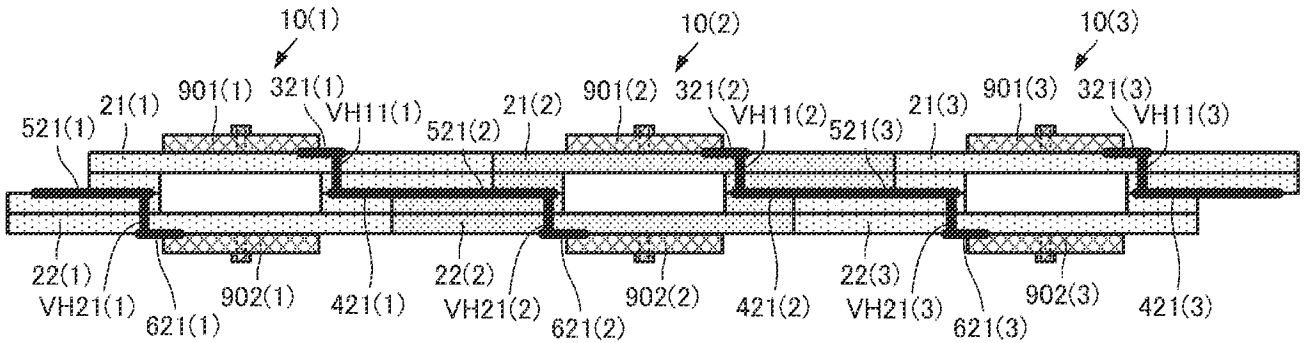
FIG. 6B is a side sectional view illustrating a coupling mode of conductor patterns in the configuration in which the multiple fluid control devices are coupled to each other.

FIG. 5 is a perspective view illustrating a configuration in which multiple fluid control devices are coupled to each other. FIG. 6A is a side sectional view illustrating a connection of the spaces in the configuration in which the multiple fluid control devices are coupled to each other. FIG. 6B is a side sectional view illustrating a coupling mode of the conductor patterns in the configuration in which the multiple fluid control devices are coupled to each other.

A fluid control device 10(1), a fluid control device 10(2), a fluid control device 10(3) in FIG. 5, FIG. 6A, and FIG. 6B have the same configuration and have the configuration of the fluid control device 10. Note that, FIG. 5, FIG. 6A, and FIG. 6B illustrate a mode in which three fluid control devices are coupled to each other, but the number of the fluid control devices may be two, or four or more.

As described above, in the fluid control device 10, the dielectric base member 21 and the dielectric base member 22 are laminated in a state of being shifted in the longitudinal direction. With this, the opening shape (first region) of the main surface 2122 of the dielectric base member 21 and the opening shape (second region) of the main surface 2221 of the dielectric base member 22 are the same. The opening direction of the main surface 2122 is opposite to the opening direction of the main surface 2221 in the thickness direction. Further, the opening portion of the main surface 2122 is positioned on one end side of the fluid control device 10 in the longitudinal direction, and the opening portion of the main surface 2221 is positioned on the other end side of the fluid control device 10 in the longitudinal direction.

In the configuration above, an end portion of the fluid control device 10(2) in the longitudinal direction, on the side where a main surface 2221(2) opens, is coupled to an end portion of the fluid control device 10(1) in the longitudinal direction, on the side where a main surface 2122(1) opens. More specifically, the surface in which the main surface 2221(2) of the fluid control device 10(2) opens is disposed to closely face or to be in contact with the surface in which the main surface 2122(1) of the fluid control device 10(1) opens. Further, an end surface 2204(2) of the fluid control device 10(2) is disposed to closely face or to be in contact with an end surface 2203(1) of the fluid control device 10(1).

Furthermore, an end surface 2103(2) of the fluid control device 10(2) is disposed to closely face or to be in contact with an end surface 2104(1) of the fluid control device 10(1).

Similarly, an end portion of the fluid control device 10(3) in the longitudinal direction, on the side where a main surface 2221(3) opens, is coupled to the end portion of the fluid control device 10(2) in the longitudinal direction, on the side where a main surface 2122(2) opens. More specifically, the surface in which the main surface 2221(3) of the fluid control device 10(3) opens is disposed to closely face or to be in contact with the surface in which the main surface 2122(2) of the fluid control device 10(2) opens. Further, an end surface 2204(3) of the fluid control device 10(3) is disposed to closely face or to be in contact with an end surface 2203(2) of the fluid control device 10(2). Furthermore, an end surface 2103(3) of the fluid control device 10(3) is disposed to closely face or to be in contact with an end surface 2104(2) of the fluid control device 10(2).

Here, the through-hole 412 constituting the recess 41 and the through-hole 512 constituting the recess 51 are formed to include the center in a width direction of the fluid control device 10. With this, as illustrated in FIG. 6A, in a coupling portion (a first coupling portion) between the fluid control device 10(1) and the fluid control device 10(2), the opening of a through-hole 412(1) of the fluid control device 10(1) and the opening of a through-hole 512(2) of the fluid control device 10(2) overlap with each other in plan view. That is, the through-hole 412(1) (recess 41(1)) of the fluid control device 10(1) and the through-hole 512(2) (recess 51(2)) of the fluid control device 10(2) communicate with each other. Similarly, in another coupling portion (a second coupling portion), a through-hole 412(2) (recess 41(2)) of the fluid control device 10(2) and a through-hole 512(3) (recess 51(3)) of the fluid control device 10(3) communicate with each other.

With this, the flow path space of the fluid control device 10(1), the flow path space of the fluid control device 10(2), and the flow path space of the fluid control device 10(3) communicate with each other, with the opening of a through-hole 512(1) (recess 51(1)) of the fluid control device 10(1) as an opening at one end and the opening of a through-hole 412(3) (recess 41(3)) of the fluid control device 10(3) as an opening at the other end. Accordingly, a fluid may be supplied from the outside to a piezoelectric pump 901(1) and a piezoelectric pump 902(1) of the fluid control device 10(1), a piezoelectric pump 901(2) and a piezoelectric pump 902(2) of the fluid control device 10(2), and a piezoelectric pump 901(3) and a piezoelectric pump 902(3) of the fluid control device 10(3) through the opening of the through-hole 512(1) and the opening of the through-hole 412(3) of the fluid control device 10(3).

With the configuration above, the fluid control device 10(1), the fluid control device 10(2), and the fluid control device 10(3) may easily realize an integrated fluid control device formed of one flat plate. This fluid control device is able to convey (control) a fluid with three times as many piezoelectric pumps in comparison with the case where the fluid control device 10(1), the fluid control device 10(2), and the fluid control device 10(3) are respectively used as a single device. That is, the fluid control device of the present embodiment may easily change and adjust the flow rate. Further, the number of piezoelectric pumps to be used may easily be changed in accordance with the number of fluid control devices to be coupled. As a result, the fluid control device of the present embodiment is able to easily adjust the flow rate.

In the configuration of the present embodiment, the disposition described above alone makes it possible to let the conductor patterns of the fluid control devices face each other and easily be coupled to each other. Specifically as illustrated, for example, in FIG. 3, the conductor pattern 421 and the conductor pattern 422 of the fluid control device 10 are disposed at positions separated with a predetermined distance from the center line in the width direction. Similarly, the conductor pattern 521 and the conductor pattern 522 of the fluid control device 10 are disposed at positions separated with a predetermined distance from the center line in the width direction. The separation distances above are the same.

Accordingly, when the fluid control device 10(1) and the fluid control device 10(2) are disposed as in FIG. 5, FIG. 6A, and FIG. 6B, a conductor pattern 421(1) of the fluid control device 10(1) closely faces or is in contact with a conductor pattern 521(2) of the fluid control device 10(2) as in FIG. 6B. With this, the conductor pattern 421(1) and the conductor pattern 521(2) are easily and more reliably coupled to each other. Similarly, a conductor pattern 421(2) and the conductor pattern 521(2) are easily and more reliably coupled to each other. Although not illustrated, a conductor pattern 422(1) and a conductor pattern 522(2) are easily and more reliably coupled to each other, and a conductor pattern 422(2) and the conductor pattern 522(2) are easily and more reliably coupled to each other.

With this, the fluid control device according to the present embodiment is able to easily and more reliably couple the multiple piezoelectric pumps 901 to each other.

Further, in the configuration described above, a connection and fixation through-hole 210(1) of the fluid control device 10(1) and a connection and fixation through-hole 220(2) of the fluid control device (2) overlap with each other in plan view. Accordingly, the fluid control device 10(1) and the fluid control device 10(2) may easily be positioned by using, for example, a member inserted through the connection and fixation through-hole 210(1) and the connection and fixation through-hole 220(2) described above. Similarly, the fluid control device 10(2) and the fluid control device 10(3) may easily be positioned by using a connection and fixation through-hole 210(2) and a connection and fixation through-hole 220(3).

In the configuration described above, the dielectric base member 21 and the dielectric base member 22 may have the same configuration. Further, the substrate 20 is formed by partially overlapping the dielectric base member 21 and the dielectric base member 22 having the same configuration with the directions of the main surfaces being opposite to each other. With this, the substrate 20 may be realized with a simple configuration.

Second Embodiment

Figure 7A:
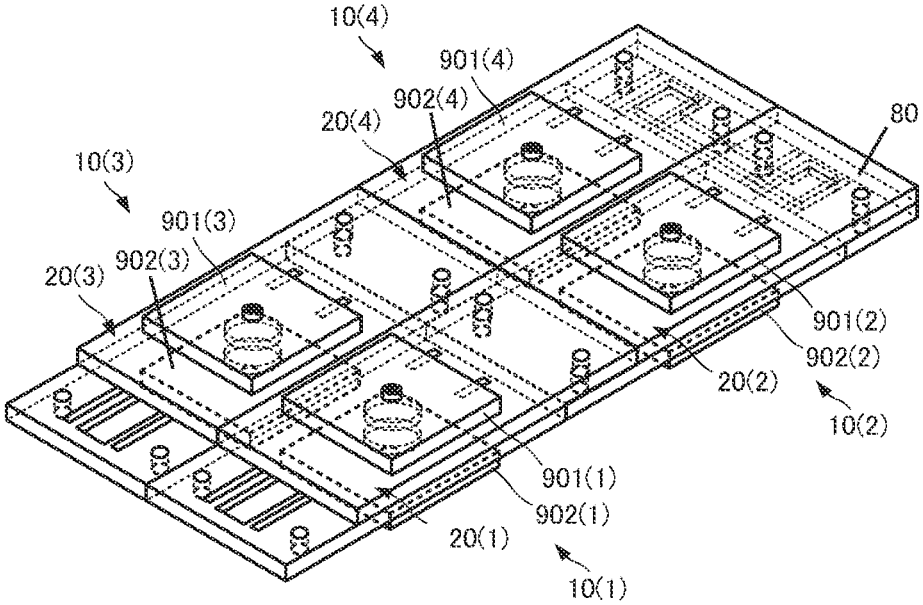
FIG. 7A is an external perspective view of a fluid control device according to a second embodiment.
Figure 7B:
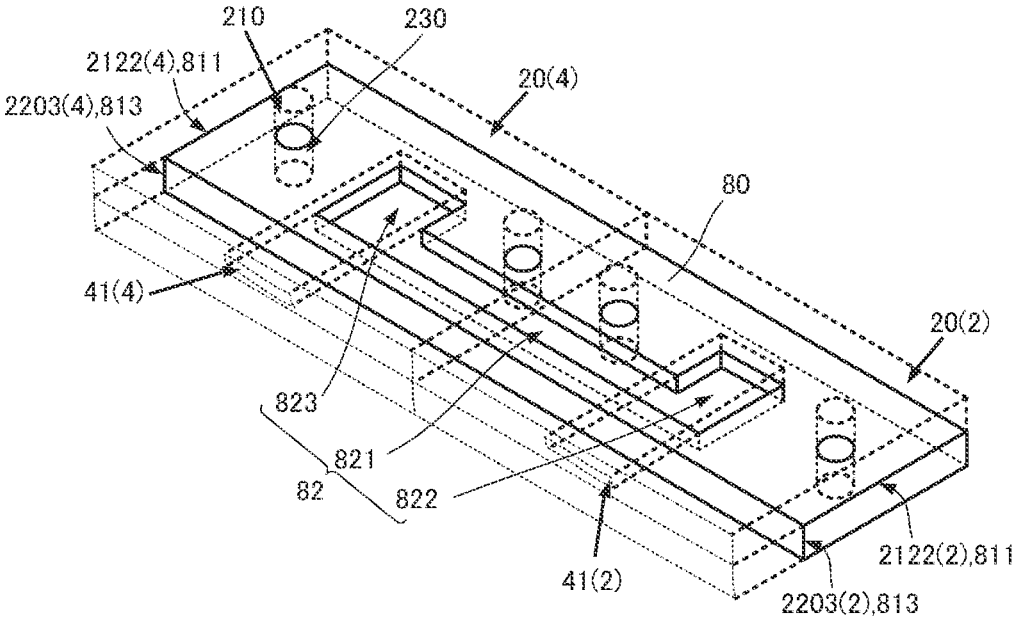
FIG. 7B is an enlarged perspective view of a position where a coupling member is disposed in the fluid control device.
Figure 8:
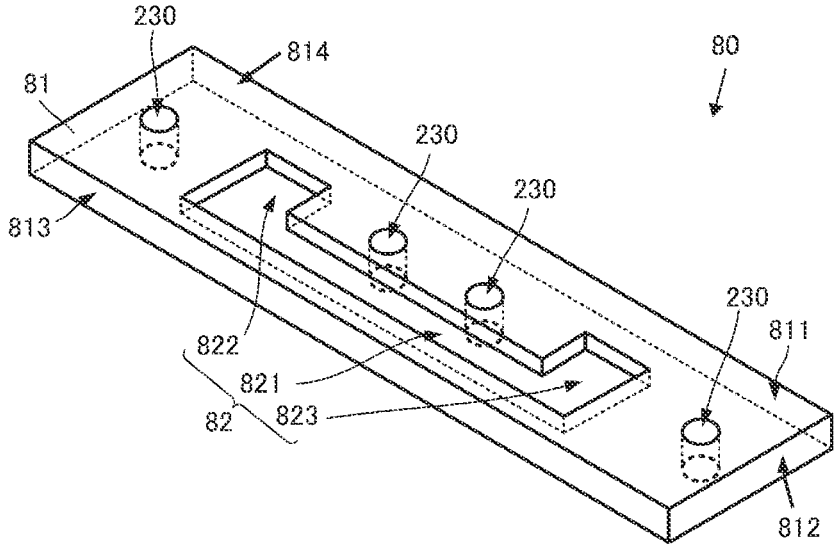
FIG. 8 is an external perspective view of the coupling member.

A fluid control device according to a second embodiment of the present disclosure will be described with reference to the drawings. FIG. 7A is an external perspective view of the fluid control device according to the second embodiment, and FIG. 7B is an enlarged perspective view of a position where a coupling member is disposed in the fluid control device. FIG. 8 is an external perspective view of the coupling member.

As illustrated in FIG. 7A, FIG. 7B, and FIG. 8, the fluid control device according to the second embodiment is different from the fluid control device according to the first embodiment in that multiple fluid control devices are coupled to each other using the coupling member. The other configurations of the fluid control device according to the second embodiment are the same as those of the fluid control device according to the first embodiment, and the description of the same portions will be omitted.

As illustrated in FIG. 7A, the fluid control device includes the fluid control device 10(1), the fluid control device 10(2), the fluid control device 10(3), and a fluid control device 10(4) that are individually prepared, and a coupling member 80.

Each of the fluid control device 10(1), the fluid control device 10(2), the fluid control device 10(3), and the fluid control device 10(4) has the same configurations as those of the fluid control device 10 described in the first embodiment.

The fluid control device 10(1) and the fluid control device 10(2) are coupled to each other along the longitudinal direction. The fluid control device 10(3) and the fluid control device 10(4) are coupled to each other along the longitudinal direction. The coupling structures above are similar to the coupling structure of the fluid control device 10(1), the fluid control device 10(2), and the fluid control device 10(3) described in the first embodiment.

A unit including the fluid control device 10(1) and the fluid control device 10(2) and a unit including the fluid control devices 10(3) and the fluid control device 10(4) are disposed along the width direction. More specifically, the fluid control device 10(1) and the fluid control device 10(3) are disposed side by side in the width direction, and the fluid control device 10(2) and the fluid control device 10(4) are disposed side by side in the width direction.

With this, the end surface 2203(2) of the fluid control device 10(2) and an end surface 2203(4) of the fluid control device 10(4) make a substantially flat surface. Similarly, the opening surface in the main surface 2122(2) of the fluid control device 10(2) and the opening surface in a main surface 2122(4) of the fluid control device 10(4) make a substantially flat surface.

The coupling member 80 is disposed in a portion surrounded by the surface in which the end surface 2203(2) and the end surface 2203(4) are coupled to each other, and the surface in which the opening surface in the main surface 2122(2) and the opening surface in the main surface 2122(4) are coupled to each other.

As illustrated in FIG. 8, the coupling member 80 includes a flat plate-shaped base member 81. The base member 81 is formed of, for example, an insulation resin. The base member 81 has a main surface 811, a main surface 812, a side surface 813, a side surface 814, and two end surfaces.

The length of each of the main surface 811 and the main surface 812 is substantially the same as the value obtained by adding the width of a substrate 20(2) and the width of a substrate 20(4). In other words, the length of each of the main surface 811 and the main surface 812 is approximately twice the width of each of the substrate 20(2) and the substrate 20(4). Further, the width of each of the main surface 811 and the main surface 812 (distance between the side surface 813 and the side surface 814) is substantially the same as each of: the length of the opening region of the main surface 2122(2) in the substrate 20(2), and the length of the opening region of the main surface 2122(4) in the substrate 20(4). The thickness of the coupling member 80 is substantially the same as the thicknesses of each of the substrate 20(2) and the substrate 20(4).

The coupling member 80 has a recess 82. The recess 82 has a shape recessed from the main surface 811. The recess 82 has a shape in which a first portion 821, a second portion 822, and a third portion 823 are connected to each other.

The first portion 821 has a shape extending in the longitudinal direction (direction orthogonal to the end surface) of the coupling member 80. The length of the first portion 821 is longer than the distance between the through-hole 412(2) of the substrate 20(2) and the through-hole 412(4) of the substrate 20(4). In other words, the length of the first portion 821 is longer than the width of each of the substrate 20(2) and the substrate 20(4), for example.

The second portion 822 and the third portion 823 have a shape extending in the width direction (direction orthogonal to the side surface 813 and the side surface 814) of the coupling member 80. The second portion 822 is coupled to one end of the first portion 821 in the extending direction. The third portion 823 is coupled to the other end of the first portion 821 in the extending direction.

As illustrated in FIG. 7A and FIG. 7B, the coupling member 80 is disposed such that the side surface 813 closely faces or is in contact with the end surface 2203(2) of the substrate 20(2) and the end surface 2203(4) of the substrate 20(4). Further, the coupling member 80 is disposed such that the main surface 811 closely faces or is in contact with the opening surface in the main surface 2122(2) of the substrate 20(2) and the opening surface in the main surface 2122(4) of the substrate 20(4).

With the configuration above, the through-hole 412(2) of the recess 41(2) in the substrate 20(2) and the through-hole 412(4) of a recess 41(4) in the substrate 20(4) communicate with each other through the recess 82 of the coupling member 80. With this, the piezoelectric pump 901(1) and the piezoelectric pump 901(1) of the fluid control device 10(1), the piezoelectric pump 902(2) and the piezoelectric pump 902(2) of the fluid control device 10(2), the piezoelectric pump 901(3) and the piezoelectric pump 902(3) of the fluid control device 10(3), and a piezoelectric pump 901(4) and a piezoelectric pump 902(4) of the fluid control device 10(4) are able to be supplied with a fluid through one flow path.

That is, even when the multiple fluid control devices are disposed side by side in the width direction, a continuously coupled flow path for all the fluid control devices may be formed, and this makes it possible to let the multiple fluid control devices function as one fluid control device. Accordingly, the coupling mode of the multiple fluid control devices may more variously be configured, and a fluid control device capable of achieving a desired flow rate may easily be realized.

As illustrated in FIG. 8, the coupling member 80 has a connection and fixation through-hole 230. As illustrated in FIG. 7A and FIG. 7B, the connection and fixation through-holes 230 overlap with the connection and fixation through-hole 210 of the substrate 20(2) and the connection and fixation through-hole 210 of the substrate 20(4), in a state where the coupling member 80 is disposed on the substrate 20(2) and the substrate 20(4). With the configuration above, by using, for example, a member inserted through the connection and fixation through-hole 230 and the connection and fixation through-hole 220, the fluid control device 10(2), the fluid control device 10(4), and the coupling member 80 may easily be positioned and fixed.

Third Embodiment

Figure 9A:
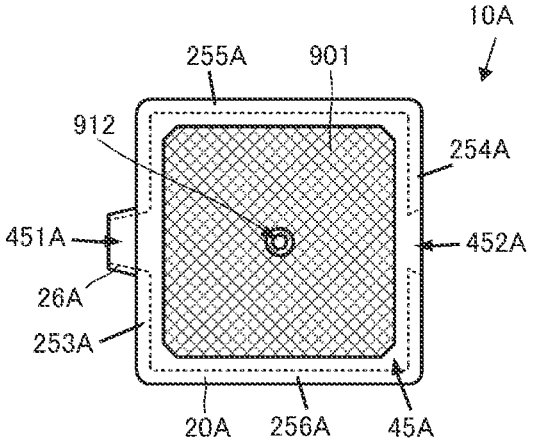
FIG. 9A is a plan view illustrating a configuration of a fluid control device according to a third embodiment.

A fluid control device according to a third embodiment of the present disclosure will be described with reference to the drawings. FIG. 9A is a plan view illustrating a configuration of the fluid control device according to the third embodiment, and FIG. 9B is a side sectional view illustrating the configuration of the fluid control device according to the third embodiment.

Figure 9B:
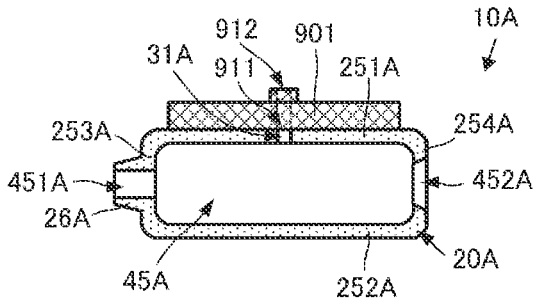
FIG. 9B is a side sectional view illustrating the configuration of the fluid control device according to the third embodiment.

As illustrated in FIG. 9A and FIG. 9B, a fluid control device 10A according to the third embodiment is different from the fluid control device 10 in that the configuration of a housing 20A is not limited to the laminated substrate and uses, for example, a resin-molded article. The basic functional structure of the fluid control device 10A is similar to that of the fluid control device 10.

As illustrated in FIG. 9A and FIG. 9B, the fluid control device 10A according to the third embodiment includes the housing 20A and the piezoelectric pump 901. The housing 20A is realized by a molded article made of, for example, a resin.

The housing 20A has a substantially rectangular parallelepiped shape. The housing 20A has a main wall 251A, a main wall 252A, a side wall 253A, a side wall 254A, a side wall 255A, and a side wall 256A. The main wall 251A and the main wall 252A face each other and are disposed orthogonal to the thickness direction of the housing 20A. The side wall 253A and the side wall 254A face each other and are disposed parallel to the thickness direction of the housing 20A. The side wall 255A and the side wall 256A face each other, are parallel to the thickness direction of the housing 20A, and are disposed orthogonal to the side wall 253A and the side wall 254A.

The housing 20A has a flow path space 45A formed of a hollow portion surrounded by the main wall 251A, the main wall 252A, the side wall 253A, the side wall 254A, the side wall 255A, and the side wall 256A.

A through-hole 31A is formed in the main wall 251A. The through-hole 31A communicates with the flow path space 45A, and also communicates with the external space of the housing 20A.

The side wall 253A has a protrusion 26A. The protrusion 26A has a shape protruding outward from an outer surface of the side wall 253A. The protrusion 26A has a substantially cylindrical shape. The area of the portion of the protrusion 26A connected to the side wall 253A is larger than the area of the tip thereof. In other words, the outer shape of the protrusion 26A is a tapered shape when the housing 20A is viewed from a side. The protrusion 26A has a through-hole 451A. The through-hole 451A communicates with the flow path space 45A, and also communicates with the external space of the housing 20A. The cross section (area when the side wall 253A is viewed in front) of the through-hole 451A can be larger than the cross section (area when the main wall 251A is viewed in front) of the through-hole 31A. With this, it is possible to suppress the through-hole 451A being a rate-limiting factor for the conveyance of a fluid. The protrusion 26A corresponds to a "first coupling portion" of the present disclosure, and the through-hole 451A corresponds to the "first opening" of the present disclosure.

The side wall 254A has a through-hole 452A. The through-hole 452A communicates with the flow path space 45A, and also communicates with the external space of the housing 20A. The through-hole 452A has a substantially cylindrical shape. In the through-hole 452A, the area in the surface communicating with the flow path space 45A is smaller than the area in the surface communicating with the outside of the housing 20A. The shape and the size of the through-hole 452A are the shape and the size into which the protrusion 26A may be inserted and fit. The through-hole 452A corresponds to a "second coupling portion (recess)" of the present disclosure, and corresponds to the "second opening" of the present disclosure.

The piezoelectric pump 901 is installed on an outer surface of the main wall 251A. In the installation, the piezoelectric pump 901 is disposed such that the surface thereof on which the suction port 911 is formed is in contact with the outer surface of the main wall 251A. Further, the piezoelectric pump 901 is disposed such that the suction port 911 communicates with the through-hole 31A.

Figure 10A:
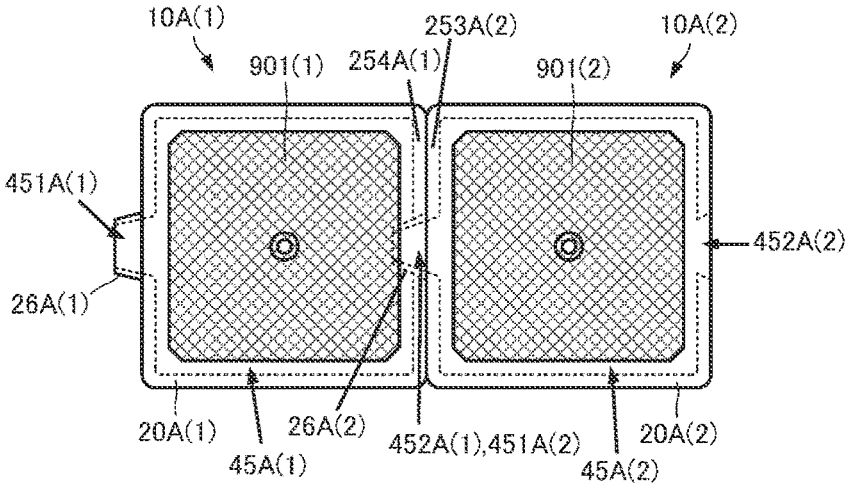
FIG. 10A is a plan view illustrating a coupling mode of multiple fluid control devices.
Figure 10B:
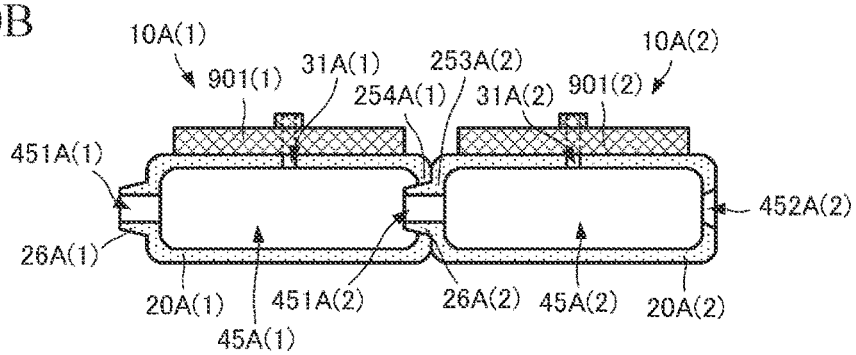
FIG. 10B is a side sectional view illustrating the coupling mode of the multiple fluid control devices.

In a case where multiple fluid control devices 10A having the configuration described above are used, the multiple fluid control devices 10A are coupled to each other as follows. FIG. 10A is a plan view illustrating a coupling mode of multiple fluid control devices, and FIG. 10B is a side sectional view illustrating the coupling mode of the multiple fluid control devices.

As illustrated in FIG. 10A, a fluid control device 10A(1) and a fluid control device 10A(2) have the same configuration as that of the fluid control device 10A described above. A protrusion 26A(2) of a housing 20A(2) of the fluid control device 10A(2) is inserted and fit into a through-hole 452A(1) of a housing 20A(1) of the fluid control device 10A(1). With this, a flow path space 45A(1) of the fluid control device 10A(1) and a flow path space 45A(2) of the fluid control device 10A(2) communicate with each other. With this, it is possible to realize a fluid control device in which the fluid control device 10A(1) and the fluid control device 10A(2) are integrated.

In the integrated fluid control device, the piezoelectric pump 901(1) of the fluid control device 10A(1) and the piezoelectric pump 901(2) of the fluid control device 10A(2) are supplied with a fluid through one flow path. Specifically, when the piezoelectric pump 901(1) and the piezoelectric pump 901(2) are driven, a fluid flows from a through-hole 451A(1) and a through-hole 452A(2) into the flow path space 45A(1) and the flow path space 45A(2) that communicate with each other through the through-hole 451A(2). The fluid is suctioned into the piezoelectric pump 901(1) through a through-hole 31A(1), and is suctioned into the piezoelectric pump 901(2) through a through-hole 31A(2). The piezoelectric pump 901(1) and the piezoelectric pump 901(2) discharge the suctioned fluid to the outside of the fluid control device 10A(1) and the fluid control device 10A(2).

With the configuration above, the integrated fluid control device is able to gain a flow rate with the piezoelectric pump 901(1) and the piezoelectric pump 901(2). That is, depending on the number of the individual fluid control devices to be coupled to each other, the flow rate may easily be changed and adjusted.

Further, in this configuration, an integrated fluid control device may be realized simply by inserting and fitting the protrusion 26A(2) into the through-hole 452A(1). Accordingly, a fluid control device capable of changing and adjusting a flow rate, or a fluid control device in which multiple fluid control devices are integrated may easily be realized.

Although not illustrated in the drawings, uneven portions that fit to each other on outer surfaces of a protrusion 26A(1) and the protrusion 26A(2), and on wall surfaces of the through-hole 452A(1) and a through-hole 452A(2) can be provided. With this, the fluid control device 10A(1) and the fluid control device 10A(2) are not easily separated from each other, and the fixed state of the fluid control device 10A(1) and the fluid control device 10A(2) becomes more reliable.

Fourth Embodiment

Figure 11A:
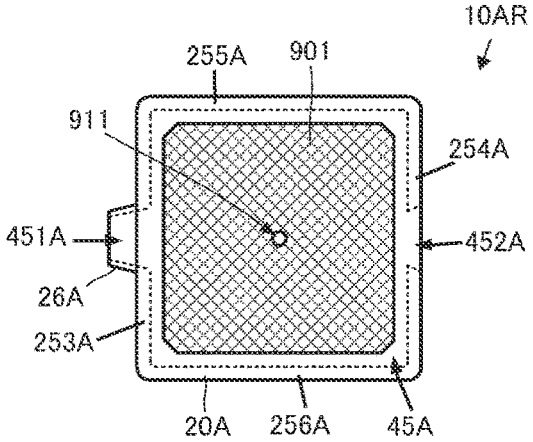
FIG. 11A is a plan view illustrating a configuration of a fluid control device according to a fourth embodiment.

A fluid control device according to a fourth embodiment of the present disclosure will be described with reference to the drawings. FIG. 11A is a plan view illustrating a configuration of the fluid control device according to the fourth embodiment, and FIG. 11B is a side sectional view illustrating the configuration of the fluid control device according to the fourth embodiment.

Figure 11B:
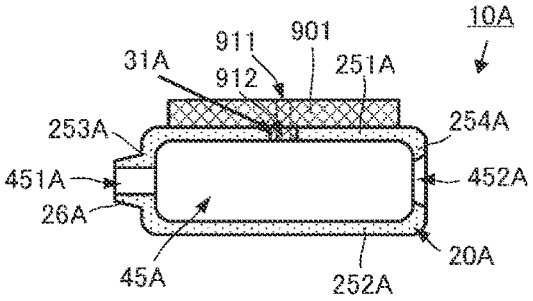
FIG. 11B is a side sectional view illustrating the configuration of the fluid control device according to the fourth embodiment.

As illustrated in FIG. 11A and FIG. 11B, a fluid control device 10AR according to the fourth embodiment is different from the fluid control device 10A according to the third embodiment in the mode of the disposition of the piezoelectric pump 901 to the housing 20A. The other configurations of the fluid control device 10AR are the same as those of the fluid control device 10A, and the description of the same portions will be omitted.

The piezoelectric pump 901 is disposed such that a surface on which the discharge port 912 is formed is in contact with the outer surface of the main wall 251A. Further, the piezoelectric pump 901 is disposed such that the discharge port 912 communicates with the through-hole 31A.

With the configuration above, the fluid control device 10AR is able to realize a fluid flow opposite to that of the fluid control device 10A.

Fifth Embodiment

Figure 12A:
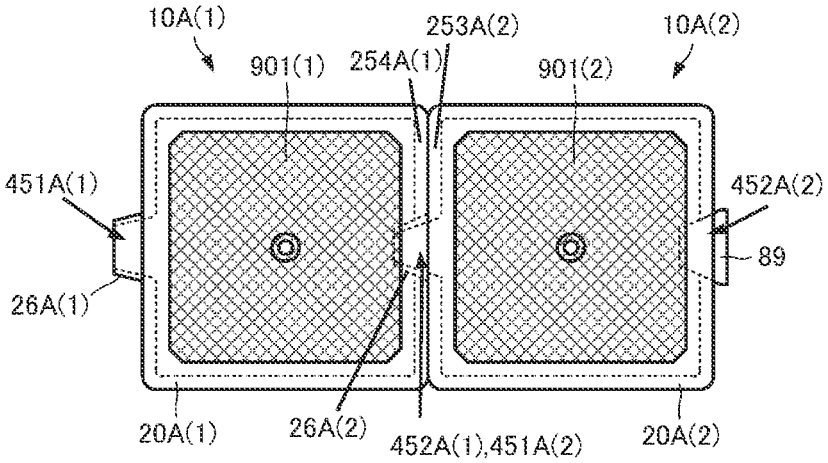
FIG. 12A is a plan view illustrating a coupling mode of multiple fluid control devices according to a fifth embodiment.

A fluid control device according to a fifth embodiment of the present disclosure will be described with reference to the drawings. FIG. 12A is a plan view illustrating a coupling mode of multiple fluid control devices according to the fifth embodiment, and FIG. 12B is a side sectional view illustrating the coupling mode of the multiple fluid control devices.

Figure 12B:
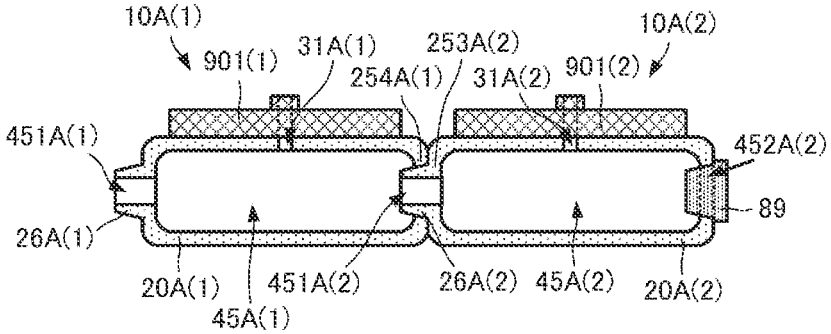
FIG. 12B is a side sectional view illustrating the coupling mode of the multiple fluid control devices.

As illustrated in FIG. 12A and FIG. 12B, an integrated fluid control device according to the fifth embodiment is different from the integrated fluid control device according to the third embodiment in that a plug member 89 is included.

The plug member 89 is a substantially cylindrical body having a shape that may be inserted and fit into the through-hole 452A(2). The plug member 89 may be made of a resin or may be an elastic body.

In this configuration, in the integrated fluid control device, a fluid flows from a through-hole 451A(1) into the flow path space 45A(1) and the flow path space 45A(2) that communicate with each other through a through-hole 451A(2). The fluid is suctioned into the piezoelectric pump 901(1) through the through-hole 31A(1), and is suctioned into the piezoelectric pump 901(2) through the through-hole 31A(2). The piezoelectric pump 901(1) and the piezoelectric pump 901(2) discharge the suctioned fluid to the outside of the fluid control device 10A(1) and the fluid control device 10A(2). Further, since the number of inlets for the fluid is one by using this configuration, it is possible to suppress turbulence in the space formed by the flow path space 45A(1) and the flow path space 45A(2) that communicate with each other through the through-hole 451A(2).

Sixth Embodiment

Figure 13A:
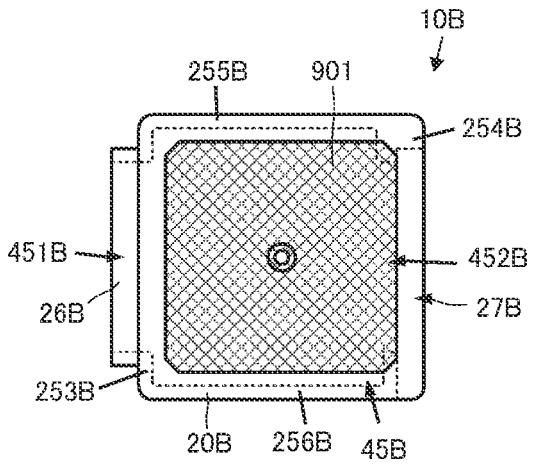
FIG. 13A is a plan view illustrating a configuration of a fluid control device according to a sixth embodiment.

A fluid control device according to a sixth embodiment of the present disclosure will be described with reference to the drawings. FIG. 13A is a plan view illustrating a configuration of the fluid control device according to the sixth embodiment, FIG. 13B is a side view illustrating the configuration of the fluid control device according to the sixth embodiment, and FIG. 13C is a side sectional view illustrating the configuration of the fluid control device according to the sixth embodiment.

Figure 13B:
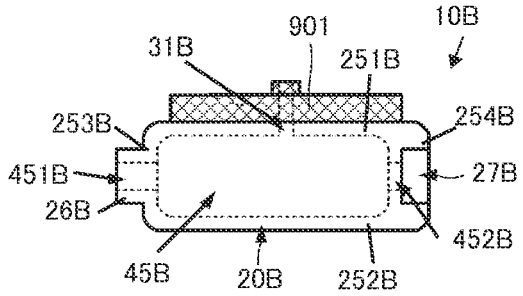
FIG. 13B is a side view illustrating the configuration of the fluid control device according to the sixth embodiment.
Figure 13C:
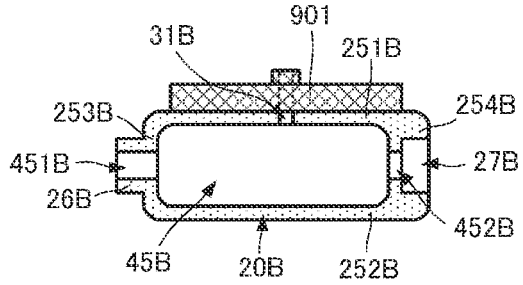
FIG. 13C is a side sectional view illustrating the configuration of the fluid control device according to the sixth embodiment.

As illustrated in FIG. 13A, FIG. 13B, and FIG. 13C, a fluid control device 10B according to the sixth embodiment is different from the fluid control device 10A according to the third embodiment in that the shape of a protrusion 26B is different and a groove 27B is included. The other configurations of the fluid control device 10B are the same as those of the fluid control device 10A, and the description of the same portions will be omitted.

A housing 20B of the fluid control device 10B has a side wall 253B and a side wall 254B. The side wall 253B includes the protrusion 26B. The protrusion 26B has a rectangular parallelepiped shape. The side wall 254B includes the groove 27B. The groove 27B has a shape opening in an outer surface of the side wall 254B and in an outer surface of a side wall 256B. The groove 27B communicates with a through-hole 452B. The groove 27B has a shape into which the protrusion 26B may be inserted and fit.

Figure 14A:
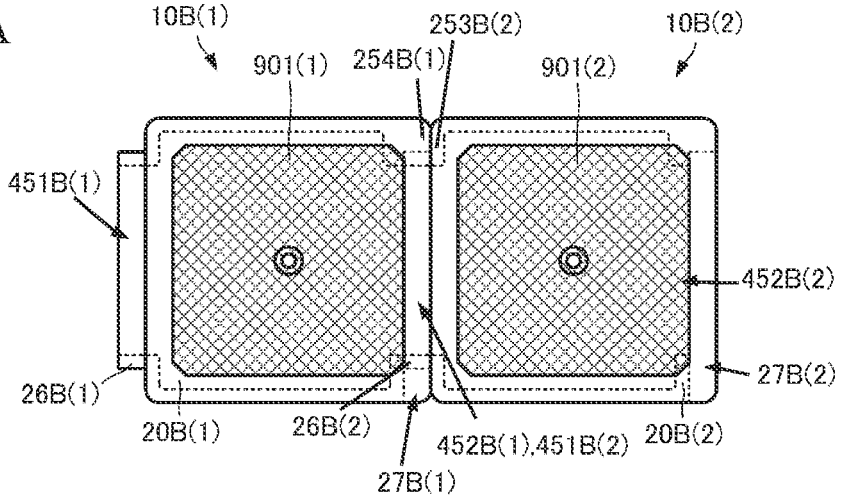
FIG. 14A is a plan view illustrating a coupling mode of multiple fluid control devices.

In a case where multiple fluid control devices 10B each having the configuration above are used, the multiple fluid control devices 10B are coupled to each other as follows. FIG. 14A is a plan view illustrating a configuration of the multiple fluid control devices, FIG. 14B is a side sectional view illustrating the coupling mode of the multiple fluid control devices, and FIG. 14C is a plan view illustrating a manner to couple the multiple fluid control devices to each other.

Figure 14B:
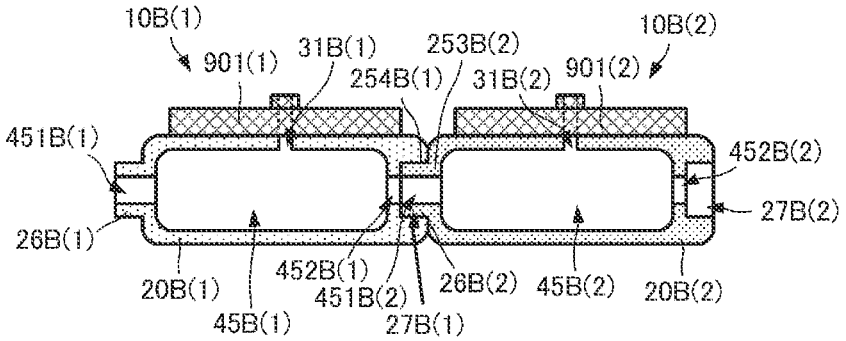
FIG. 14B is a side sectional view illustrating the coupling mode of the multiple fluid control devices.

As illustrated in FIG. 14A and FIG. 14B, a protrusion 26B(2) of a fluid control device 10B(2) is inserted and fit into a groove 27B(1) of a fluid control device 10B(1). With this, it is possible to realize a fluid control device in which the fluid control device 10B(1) and the fluid control device 10B(2) are integrated.

Figure 14C:
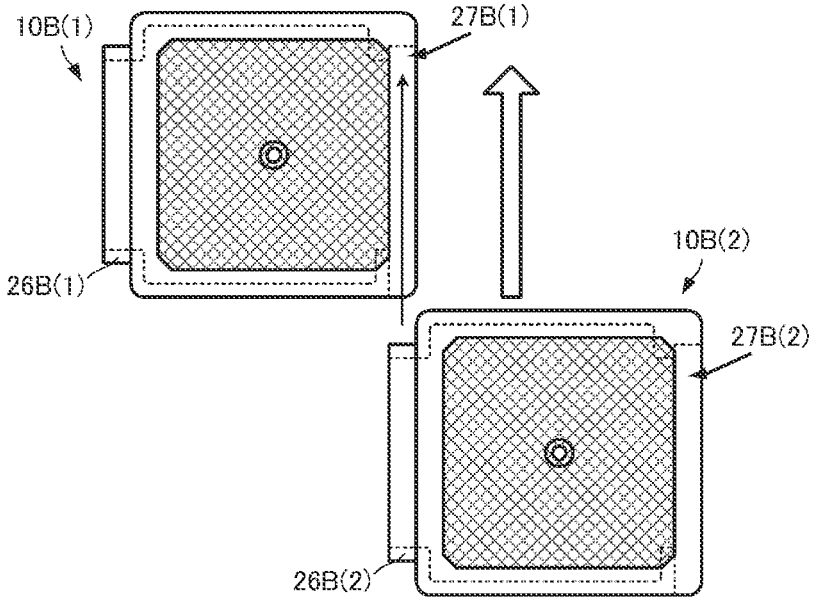
FIG. 14C is a plan view illustrating a manner to couple the multiple fluid control devices to each other.

In this integrated fluid control device, as illustrated in FIG. 14C, the protrusion 26B(2) of the fluid control device 10B(2) may be inserted and fit into the groove 27B(1) of the fluid control device 10B(1) while being slid. That is, the protrusion 26B(2) is easily guided in a specific direction along the groove 27B(1). In this configuration, since the coupling area between the protrusion 26B(2) and the groove 27B(1) is large, it is possible to more reliably maintain a stable fixed state. Further, the cross section of a through-hole 451B(2) may be increased, and this makes it possible to suppress the rate-limiting factor for the conveyance of a fluid due to the through-hole 451B(2).

Seventh Embodiment

Figure 15A:
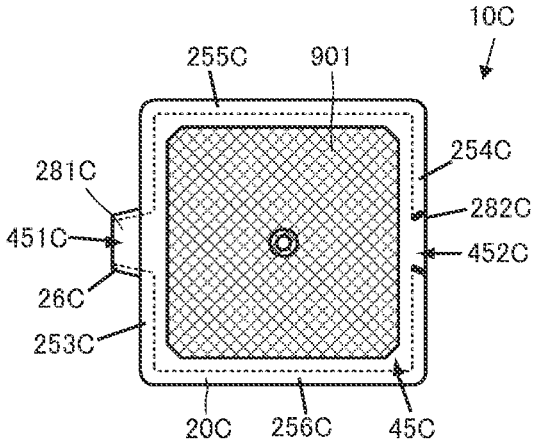
FIG. 15A is a plan view illustrating a configuration of a fluid control device according to a seventh embodiment.

A fluid control device according to a seventh embodiment of the present disclosure will be described with reference to the drawings. FIG. 15A is a plan view illustrating a configuration of the fluid control device according to the seventh embodiment, and FIG. 15B is a side sectional view illustrating the configuration of the fluid control device according to the seventh embodiment.

Figure 15B:
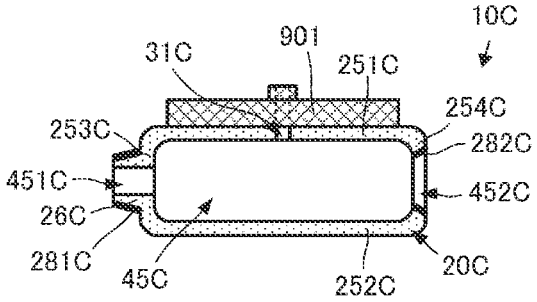
FIG. 15B is a side sectional view illustrating the configuration of the fluid control device according to the seventh embodiment.

As illustrated in FIG. 15A and FIG. 15B, a fluid control device 10C according to the seventh embodiment is different from the fluid control device 10A according to the third embodiment in that a magnet 281C and a magnet 282C are included. The other configurations of the fluid control device 10C are the same as those of the fluid control device 10A, and the description of the same portions will be omitted.

The magnet 281C is disposed at a protrusion 26C of a housing 20C of the fluid control device 10C. The magnet 282C is disposed on the side wall of a through-hole 452C in a side wall 254C of the housing 20C. The magnet 281C and the magnet 282C have opposite polarities.

In the configuration above, when the protrusion 26C of one fluid control device 10C is inserted and fit into the through-hole 452C of another fluid control device 10C coupled to the one fluid control device 10C, an attractive force is generated between the magnet 281C and the magnet 282C. With this, the fixed state of the two fluid control devices 10C coupled to each other becomes stable. Further, since the magnet 281C and the magnet 282C attract each other at the time of coupling, two fluid control devices 10C to be coupled may easily be coupled.

In the present embodiment, there is described a mode in which the magnet 281C is disposed at the protrusion 26C, and the magnet 282C is disposed on the side wall of the through-hole 452C. However, it is acceptable that one of those disposed at the protrusion 26C and disposed on the side wall of the through-hole 452C is a magnet, and the other is a magnetic body such as metal. That is, the present disclosure is not limited to a mode in which two magnets are used, but may have a configuration in which the protrusion 26C and the side wall of the through-hole 452C are attracted to each other and are fixed by a magnetic force.

Eighth Embodiment

Figure 16A:
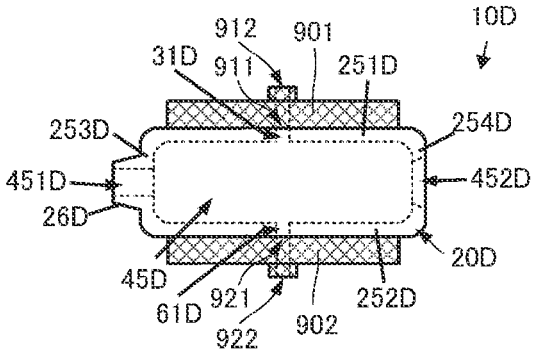
FIG. 16A is a side view illustrating a configuration of a fluid control device according to an eighth embodiment.

A fluid control device according to an eighth embodiment of the present disclosure will be described with reference to the drawings. FIG. 16A is a side view illustrating a configuration of the fluid control device according to the eighth embodiment, and FIG. 16B is a side sectional view illustrating the configuration of the fluid control device according to the eighth embodiment.

Figure 16B:
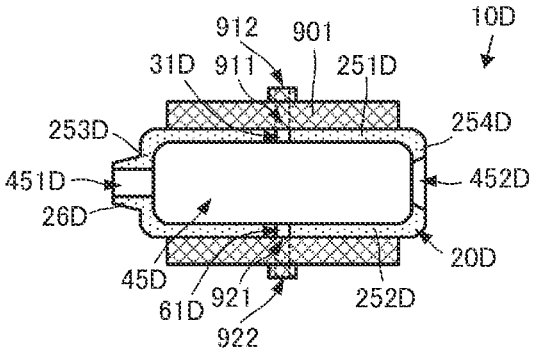
FIG. 16B is a side sectional view illustrating the configuration of the fluid control device according to the eighth embodiment.

As illustrated in FIG. 16A and FIG. 16B, a fluid control device 10D according to the eighth embodiment is different from the fluid control device 10A according to the third embodiment in that the piezoelectric pump 902 is further included. The other configurations of the fluid control device 10D are the same as those of the fluid control device 10A, and the description of the same portions will be omitted.

The fluid control device 10D includes a housing 20D, the piezoelectric pump 901, and the piezoelectric pump 902. A main wall 251D of the housing 20D has a through-hole 31D, and a main wall 252D of the housing 20D has a through-hole 61D.

The piezoelectric pump 901 is installed on an outer surface of the main wall 251D. In the installation, the piezoelectric pump 901 is disposed such that the suction port 911 communicates with the through-hole 31D. The piezoelectric pump 902 is installed on an outer surface of the main wall 252D. In the installation, the piezoelectric pump 902 is disposed such that the suction port 921 communicates with the through-hole 61D.

As described above, the fluid control device 10D is able to gain a flow rate with the piezoelectric pumps twice as many as the piezoelectric pump of the fluid control device 10A. Although not illustrated, a piezoelectric pump may be disposed on at least one of two side walls other than a side wall 253D and a side wall 254D in the housing 20D.

Ninth Embodiment

Figure 17A:
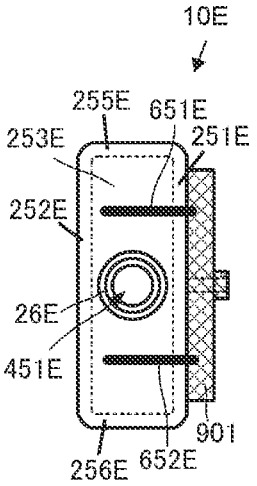
FIG. 17A is a first side view (first end surface view) illustrating a configuration of a fluid control device according to a ninth embodiment.

A fluid control device according to a ninth embodiment of the present disclosure will be described with reference to the drawings. FIG. 17A is a first side view (first end surface view) illustrating a configuration of the fluid control device according to the ninth embodiment, FIG. 17B is a plan view illustrating the configuration of the fluid control device according to the ninth embodiment, and FIG. 17C is a second side view (second end surface view) illustrating the configuration of the fluid control device according to the ninth embodiment.

Figure 17B:
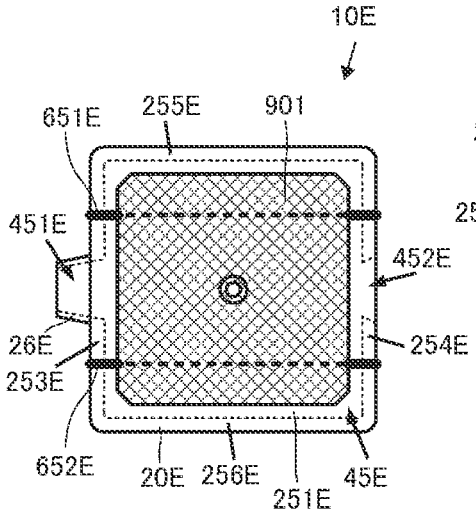
FIG. 17B is a plan view illustrating the configuration of the fluid control device according to the ninth embodiment.
Figure 17C:
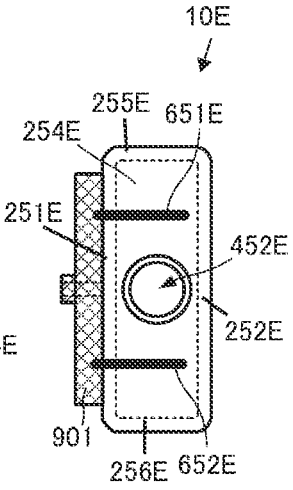
FIG. 17C is a second side view (second end surface view) illustrating the configuration of the fluid control device according to the ninth embodiment.

As illustrated in FIGS. 17A, 17B, and 17C, a fluid control device 10E according to the ninth embodiment is different from the fluid control device 10A according to the third embodiment in that a conductor pattern 651E and a conductor pattern 652E are included. The other configurations of the fluid control device 10E are the same as those of the fluid control device 10A, and the description of the same portions will be omitted.

The conductor pattern 651E and the conductor pattern 652E are formed on a housing 20E. More specifically, the conductor pattern 651E and the conductor pattern 652E are formed on a main wall 251E of the housing 20E. One ends of the conductor pattern 651E and the conductor pattern 652E reach a side wall 253E, and the other ends reach a side wall 254E.

The conductor pattern 651E and the conductor pattern 652E are electrically connected to the piezoelectric pump 901.

Figure 18:
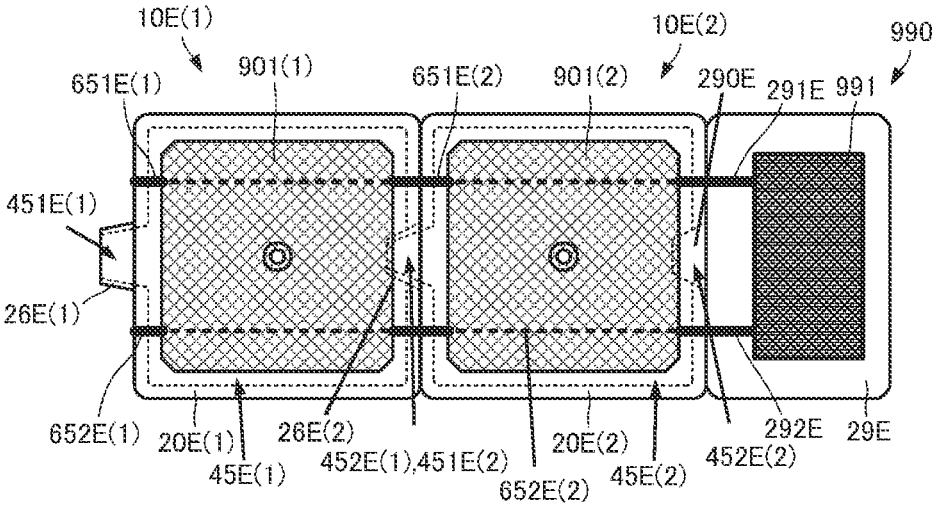
FIG. 18 is a plan view illustrating a coupling mode of multiple fluid control devices.
Figure 19A:
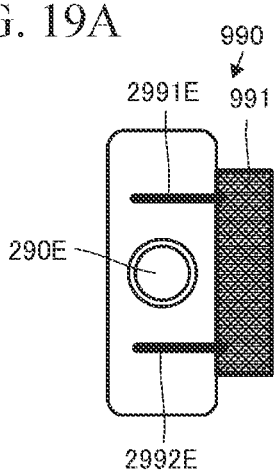
FIG. 19A is a first side view of a driving unit.

In a case where multiple fluid control devices 10E each having the configuration above are used, the multiple fluid control devices 10E are coupled to each other as follows. FIG. 18 is a plan view illustrating a coupling mode of multiple fluid control devices. FIG. 19A is a first side view of a driving unit, and FIG. 19B is a plan view of the driving unit.

As illustrated in FIG. 18, when a fluid control device 10E(1) and a fluid control device 10E(2) are coupled to each other, a conductor pattern 651E(1) and a conductor pattern 651E(2) are coupled to each other with the portion formed on the side wall. Similarly, a conductor pattern 652E(1) and a conductor pattern 652E(2) are coupled to each other with the portion formed on the side wall. As described above, in the configuration of the present embodiment, the fluid control device 10E(1) and the fluid control device 10E(2) may electrically be coupled to each other with ease.

Figure 19B:
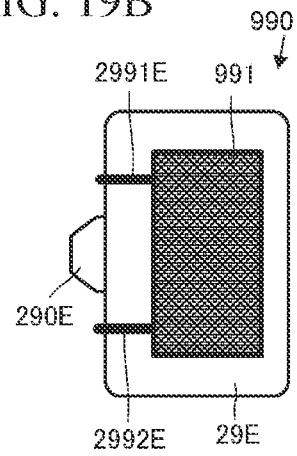
FIG. 19B is a plan view of the driving unit.

Further, in this configuration, by including a driving unit 990 illustrated in FIG. 19A and FIG. 19B, it is possible to easily supply a driving signal to the fluid control device 10E(1) and the fluid control device 10E(2).

The driving unit 990 includes a housing 29E having a substantially rectangular parallelepiped shape. One side wall of the housing 29E includes a protrusion 290E. The protrusion 290E has a shape that may be inserted and fit into a through-hole 452E. The driving unit 990 includes a driving circuit component 991, a conductor pattern 2991E, and a conductor pattern 2992E. The driving circuit component 991 is disposed on one main surface of the housing 29E. The conductor pattern 2991E and the conductor pattern 2992E are formed over the main surface on which the driving circuit component 991 is disposed and the side surface from which the protrusion 290E protrudes. The conductor pattern 2991E and the conductor pattern 2992E are connected to the driving circuit component 991.

As illustrated in FIG. 18, the driving unit 990 is disposed such that the protrusion 290E is inserted and fit into a through-hole 452E(2) of the fluid control device 10E(2). With this, the conductor pattern 2991E of the driving unit 990 is coupled to the conductor pattern 651E(2) of the fluid control device 10E(2). Similarly, the conductor pattern 2992E of the driving unit 990 is coupled to the conductor pattern 652E(2) of the fluid control device 10E(2).

With the configuration above, the piezoelectric pump 901(1) of the fluid control device 10E(1) and the piezoelectric pump 901(2) of the fluid control device 10E(2) may electrically be coupled to the driving circuit component 991 of the driving unit 990 with ease and reliability.

Tenth Embodiment

Figure 20A:
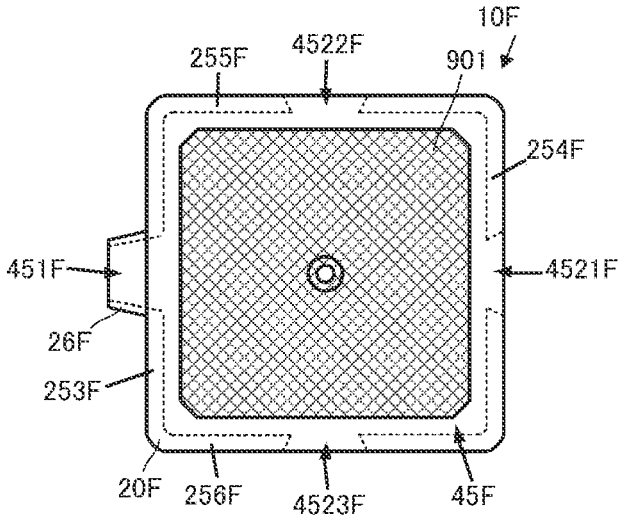
FIG. 20A is a plan view illustrating a configuration of a fluid control device according to a tenth embodiment.

A fluid control device according to a tenth embodiment of the present disclosure will be described with reference to the drawings. FIG. 20A is a plan view illustrating a configuration of the fluid control device according to the tenth embodiment, and FIG. 20B is a plan view illustrating a configuration of an integrated fluid control device using multiple fluid control devices according to the tenth embodiment.

As illustrated in FIG. 20A, a fluid control device 10F according to the tenth embodiment is different from the fluid control device 10A according to the third embodiment in that a through-hole 4521F, a through-hole 4522F, and a through-hole 4523F are included. The other configurations of the fluid control device 10F are the same as those of the fluid control device 10A, and the description of the same portions will be omitted.

The through-hole 4521F is formed in a side wall 254F, the through-hole 4522F is formed in a side wall 255F, and the through-hole 4523F is formed in a side wall 256F.

Figure 20B:
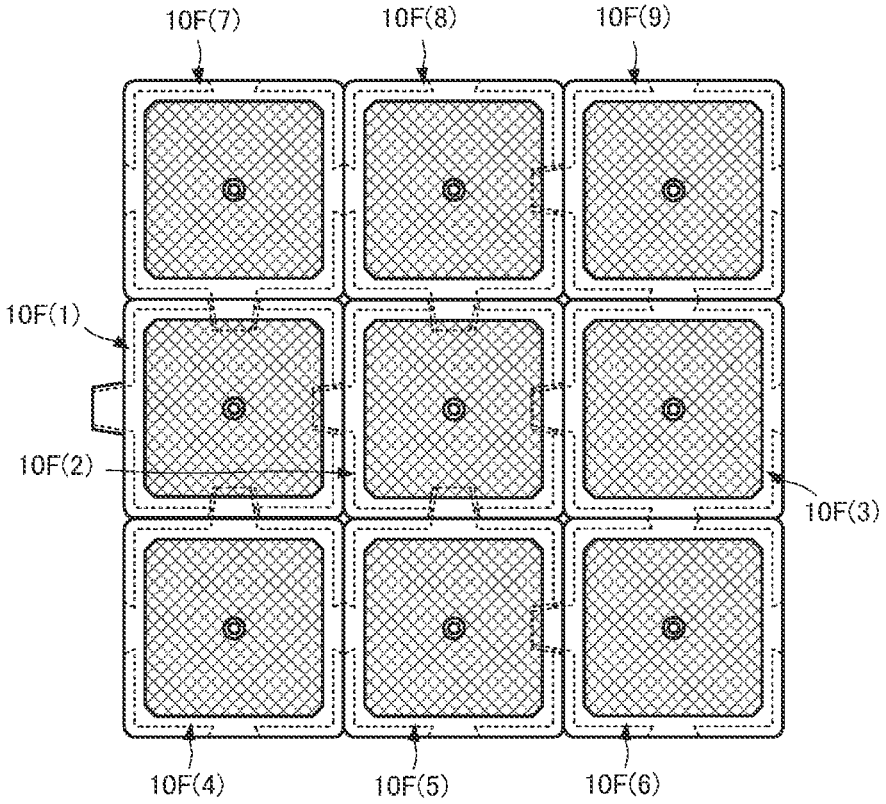
FIG. 20B is a plan view illustrating a configuration of an integrated fluid control device using multiple fluid control devices according to the tenth embodiment.

With the configuration above, as illustrated in FIG. 20B, multiple fluid control devices 10F (multiple fluid control devices 10F(1) to 10F(9)) may be coupled in a two-dimensional array. In the mode illustrated in FIG. 20B, a fluid control device 10F(1), a fluid control device 10F(2), and a fluid control device 10F(3) are disposed in a row (first row) in terms of outer shape. A fluid control device 10F(4), a fluid control device 10F(5), and a fluid control device 10F(6) are disposed in a row (second row). A fluid control device 10F(7), a fluid control device 10F(8), and a fluid control device 10F(9) are disposed in a row (third row).

The multiple fluid control devices 10F(4) to 10F(6) in the second row and the multiple fluid control devices 10F(7) to 10F(9) in the third row are disposed to sandwich the multiple fluid control devices 10F(1) to 10F(3) in the first row.

As illustrated in FIG. 20B, the fluid control device 10F(1) is coupled to the fluid control device 10F(2), the fluid control device 10F(4), and the fluid control device 10F(7). In other words, the flow path space of the fluid control device 10F(1) communicates with the flow path space of the fluid control device 10F(2), the flow path space of the fluid control device 10F(4), and the flow path space of the fluid control device 10F(7).

The fluid control device 10F(2) is coupled to the fluid control device 10F(3), the fluid control device 10F(5), and the fluid control device 10F(8). In other words, the flow path space of the fluid control device 10F(2) communicates with the flow path space of the fluid control device 10F(3), the flow path space of the fluid control device 10F(5), and the flow path space of the fluid control device 10F(8).

Further, the fluid control device 10F(5) is coupled to the fluid control device 10F(6). In other words, the flow path space of the fluid control device 10F(5) communicates with the flow path space of the fluid control device 10F(6). Furthermore, the fluid control device 10F(8) is coupled to the fluid control device 10F(9). In other words, the flow path space of the fluid control device 10F(8) communicates with the flow path space of the fluid control device 10F(9).

As described above, having the configuration of the fluid control device 10F makes it possible to couple the multiple fluid control devices to each other in more various coupling modes. Accordingly, a wider variety of flow rates may be set.

Eleventh Embodiment

Figure 21A:
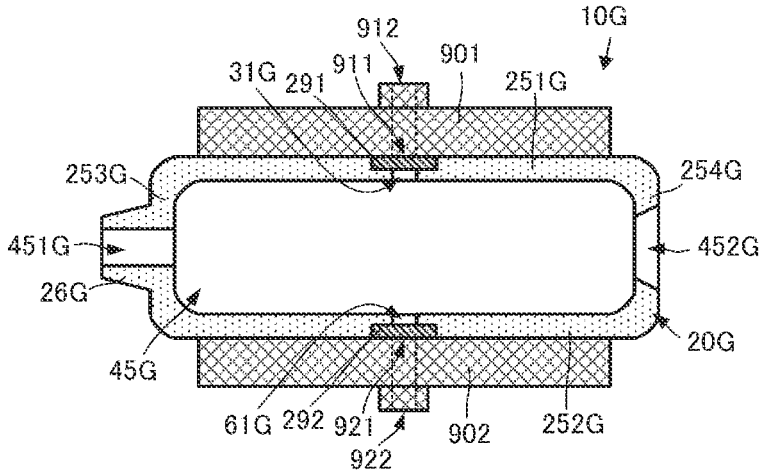
FIG. 21A is a side sectional view illustrating a configuration of a fluid control device according to an eleventh embodiment.

A fluid control device according to an eleventh embodiment of the present disclosure will be described with reference to the drawings. FIG. 21A is a side sectional view illustrating a configuration of the fluid control device according to the eleventh embodiment, FIG. 21B is a diagram illustrating a flow of a fluid to/from the fluid control device according to the eleventh embodiment, and FIG. 21C is a diagram illustrating a flow of a fluid in a state where one piezoelectric pump is removed.

Figure 21B:
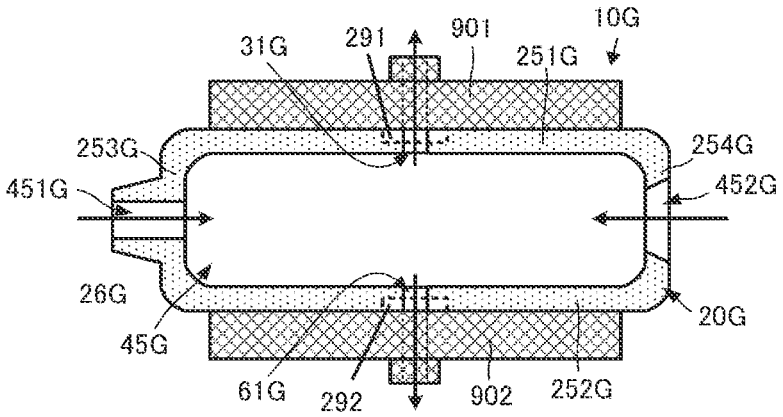
FIG. 21B is a diagram illustrating a flow of a fluid to/from the fluid control device according to the eleventh embodiment.
Figure 21C:
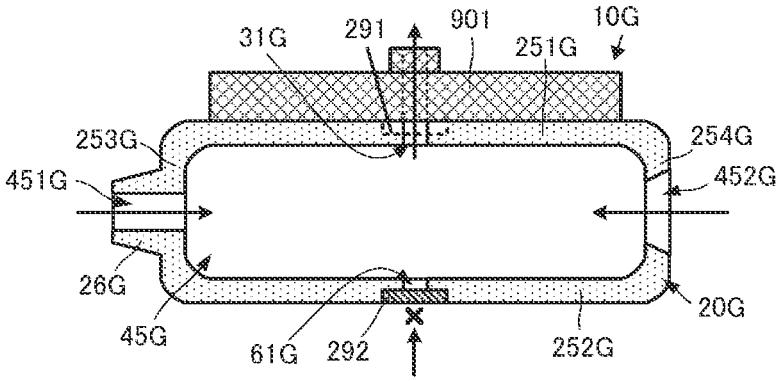
FIG. 21C is a diagram illustrating a flow of the fluid in a state where one piezoelectric pump is removed.

As illustrated in FIG. 21A, FIG. 21B, and FIG. 21C, a fluid control device 10G according to the eleventh embodiment is different from the fluid control device 10D according to the eighth embodiment in that a check valve 291 and a check valve 292 are included. The other configurations of the fluid control device 10G are the same as those of the fluid control device 10D, and the description of the same portions will be omitted.

The check valve 291 is disposed at the position of a through-hole 31G in a main wall 251G of a housing 20G. The check valve 291 allows a fluid flowing from a flow path space 45G to the outside of the housing 20G through the through-hole 31G to pass through with low resistance, whereas the check valve 291 blocks a fluid flowing from the outside of the housing 20G to the flow path space 45G through the through-hole 31G.

The check valve 292 is disposed at the position of a through-hole 61G in a main wall 252G of the housing 20G. The check valve 292 allows a fluid flowing from the flow path space 45G to the outside of the housing 20G through the through-hole 61G to pass through with low resistance, whereas the check valve 292 blocks a fluid flowing from the outside of the housing 20G to the flow path space 45G through the through-hole 61G.

With the configuration above, as illustrated in FIG. 21B, the piezoelectric pump 901 and the piezoelectric pump 902 are disposed on the housing 20G, and in a state where these pumps are driven, the fluid control device 10G conveys a fluid from the flow path space 45G to the outside of the housing 20G.

Whereas, for example, as illustrated in FIG. 21C, in a state where the piezoelectric pump 902 is not disposed on the housing 20G, the fluid control device 10G conveys a fluid from the flow path space 45G to the outside of the housing 20G using the piezoelectric pump 901 alone. At this time, since the through-hole 61G is closed with the check valve 292, a fluid does not flow back to the flow path space 45G from the outside of the housing 20G through the through-hole 61G.

As described above, having the configuration of the fluid control device 10G makes it possible to selectively dispose at least one of the piezoelectric pump 901 and the piezoelectric pump 902. Further, the fluid control device 10G may achieve efficient conveyance of a fluid depending on the mode of disposition.

Twelfth Embodiment

Figure 22A:
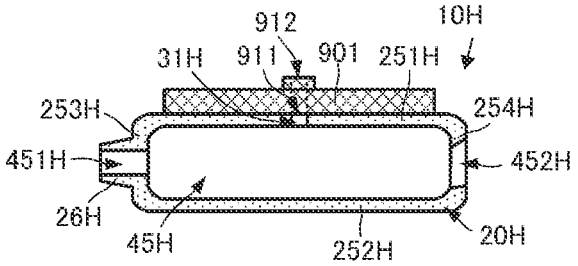
FIG. 22A is a side sectional view illustrating a configuration of a fluid control device according to a twelfth embodiment.

A fluid control device according to a twelfth embodiment of the present disclosure will be described with reference to the drawings. FIG. 22A is a side sectional view illustrating a configuration of the fluid control device according to the twelfth embodiment, and FIG. 22B is a side sectional view illustrating the configuration of an integrated fluid control device using multiple fluid control devices according to the twelfth embodiment.

Figure 22B:
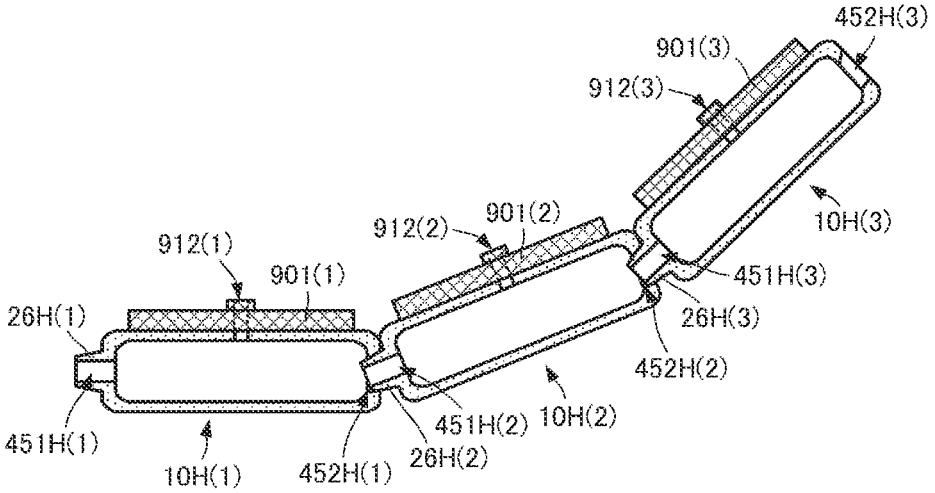
FIG. 22B is a side sectional view illustrating the configuration of an integrated fluid control device using multiple fluid control devices according to the twelfth embodiment.

As illustrated in FIG. 22A and FIG. 22B, a fluid control device 10H according to the twelfth embodiment differs from the fluid control device 10A according to the third embodiment in the structure of a through-hole 452H. The other configurations of the fluid control device 10H are the same as those of the fluid control device 10A, and the description of the same portions will be omitted.

As illustrated in FIG. 22A, in the fluid control device 10H, the opening of the through-hole 452H to the outside of a housing 20H is shifted to a main wall 251H side relative to the opening of the through-hole 452H to communicate with a flow path space 45H.

In the configuration above, as illustrated in FIG. 22B, multiple fluid control devices 10H (multiple fluid control devices 10H(1) to 10H(3)) may be coupled on a curved line (on a polygonal line). In the example of FIG. 21B, the fluid control device 10H(2) is coupled to the fluid control device 10H(1), and the fluid control device 10H(3) is coupled to the fluid control device 10H(2). Since a through-hole 452H(1), a through-hole 452H(2), and a through-hole 452H(3) are configured as described above, three directions below are not parallel to each other. The three directions are the direction in which a discharge port 912(1) of a piezoelectric pump 901(1) of the fluid control device 10H(1) discharges a fluid, the direction in which a discharge port 912(2) of a piezoelectric pump 901(2) of the fluid control device 10H(2) discharges a fluid, and the direction in which a discharge port 912(3) of a piezoelectric pump 901(3) of the fluid control device 10H(3) discharges a fluid.

With this, for example, the fluid discharge direction of the piezoelectric pump 901(1), the fluid discharge direction of the piezoelectric pump 901(2), and the fluid discharge direction of the piezoelectric pump 901(3) may be concentrated to one point.

Further, for example, in a case where an object on which an integrated fluid control device is disposed is a wall having a non-planar shape such as a curved surface, the multiple fluid control devices may be disposed along the shape of the wall. With this, it is possible to realize an integrated fluid control device capable of supplying a flow rate that suits the shape of an object and is suitable to the object.

Note that the configurations of the embodiments described above can appropriately be combined. Further, it is possible to achieve an operational effect in accordance with each combination.

REFERENCE SIGNS LIST

10, 10A, 10AR, 10B, 10C, 10D, 10E, 10F, 10G, 10H FLUID CONTROL DEVICE
20 SUBSTRATE
20A, 20B, 20C, 20D, 20E, 20F, 20G, 20H HOUSING
21, 22 DIELECTRIC BASE MEMBER
26A, 26B, 26C PROTRUSION
27B GROOVE
29E HOUSING
31, 31A, 31D, 31G THROUGH-HOLE
41, 51 RECESS
45A, 45G, 45H FLOW PATH SPACE
61, 61D, 61G THROUGH-HOLE
80 COUPLING MEMBER
81 BASE MEMBER
82 RECESS
89 PLUG MEMBER
210 CONNECTION AND FIXATION THROUGH-HOLE
211, 212, 221, 222 DIELECTRIC LAYER
220, 230 CONNECTION AND FIXATION THROUGH-HOLE
251A, 251D, 251E, 251G, 251H, 252A, 252D, 252G MAIN WALL
253A, 253B, 253D, 253E, 254A, 254B, 254C, 254D, 254E, 254F, 255A, 255F, 256A, 256B, 256F SIDE WALL
281C, 282C MAGNET
290E PROTRUSION
291, 292 CHECK VALVE
321, 322 CONDUCTOR PATTERN
411, 412 THROUGH-HOLE
421, 422 CONDUCTOR PATTERN
451, 451A, 451B, 452, 452A, 452B, 452C, 452E, 452H, 511, 512 THROUGH-HOLE
521, 522, 531, 532, 621, 622, 651E, 652E CONDUCTOR PATTERN
811, 812 MAIN SURFACE
813, 814 SIDE SURFACE
821 FIRST PORTION
822 SECOND PORTION
823 THIRD PORTION
901, 902, 903, 904 PIEZOELECTRIC PUMP
911, 921 SUCTION PORT
912, 922 DISCHARGE PORT
990 DRIVING UNIT
991 DRIVING CIRCUIT COMPONENT
2103, 2104, 2203, 2204 END SURFACE
2111, 2112, 2121, 2122 MAIN SURFACE
2211, 2212, 2221, 2222 MAIN SURFACE
2991E, 2992E CONDUCTOR PATTERN
4521F, 4522F, 4523F THROUGH-HOLE
VH11, VH12, VH21, VH22 VIA CONDUCTOR

The invention claimed is:

1. A fluid control device, comprising:

a plurality of pumps configured to convey a fluid; and a housing at which a first pump of said plurality of pumps is installed, wherein the housing includes:

a space in the housing, a communication hole configured to communicate the space with the first pump, a first coupling portion and a second coupling portion physically coupling to an external member, a first opening in the first coupling portion and making the space open to an outside, a second opening in the second coupling portion and making the space open to the outside, and the first coupling portion and the second coupling portion have outer shapes that may be fit to each other such that when the housing is coupled to another housing, the two housings communicate with each other through the first opening of the housing and the second opening of the other housing, wherein said housing includes a plurality of walls that collectively define said space, wherein said communication hole is formed in a first wall of said plurality of walls, and wherein said first pump is disposed outside of said space and overlays an external surface of said first wall.

2. The fluid control device according to claim 1, wherein the housing has a first conductor pattern and a second conductor pattern electrically connected to the first pump, part of the first conductor pattern is in the first coupling portion, part of the second conductor pattern is in the second coupling portion, and the first conductor pattern and the second conductor pattern have a shape that when the housing and the other housing are coupled to each other, the first conductor pattern of the housing and the second conductor pattern of the other housing are coupled to each other.

3. The fluid control device according to claim 1, wherein the housing is formed of laminated substrates in which a first dielectric base member and a second dielectric base member are laminated, and the space comprises a first recess in the first dielectric base member and a second recess in the second dielectric base member.

4. The fluid control device according to claim 3, wherein the housing includes:

a first region made of the first dielectric base member alone and not overlapping with the second dielectric base member and a second region made of the second dielectric base member alone and not overlapping with the first dielectric base member, the first coupling portion is in the first region, and the second coupling portion is in the second region.

5. The fluid control device according to claim 3, wherein the first dielectric base member and the second dielectric base member have a same shape, and the first dielectric base member and the second dielectric base member partially overlap with each other, a main surface of the first dielectric base member faces opposite from the second dielectric base member, a main surface of the second dielectric base member faces opposite from the first dielectric base member.

6. The fluid control device according to claim 3, wherein the plurality of pumps further includes a second pump, the communication hole includes a first communication hole and a second communication hole, the first communication hole is in the first dielectric base member, the second communication hole is in the second dielectric base member, the first pump is on a surface of the first dielectric base member opposite from a surface connected to the second dielectric base member, and the second pump is on a surface of the second dielectric base member opposite from a surface connected to the first dielectric base member.

7. The fluid control device according to claim 1, wherein the first coupling portion comprises a protrusion on the housing, and the second coupling portion comprises a recess in the housing.

8. The fluid control device according to claim 7, wherein the protrusion of the first coupling portion is configured to fit the recess of the second coupling portion.

9. The fluid control device according to claim 7, wherein the second coupling portion has a groove that guides the protrusion in a specific direction.

10. The fluid control device according to claim 1, wherein the first coupling portion and the second coupling portion have structures that are fixed to each other by magnetic force.

11. The fluid control device according to claim 1, wherein the fluid control device further comprises a plug member to close the first opening or the second opening.

12. The fluid control device according to claim 1, wherein the protrusion of the first coupling portion of the housing fits the recess of the second coupling portion of another housing and communicates the first opening of the housing with the second opening of another housing.

13. The fluid control device according to claim 2, wherein the housing is formed of laminated substrates in which a first dielectric base member and a second dielectric base member are laminated, and the space is formed by a first recess formed in the first dielectric base member and a second recess formed in the second dielectric base member.

14. The fluid control device according to claim 2, wherein the first coupling portion and the second coupling portion have structures that are fixed to each other by magnetic force.

15. The fluid control device according to claim 7, wherein the first coupling portion and the second coupling portion have structures that are fixed to each other by magnetic force.

16. The fluid control device according to claim 8, wherein the first coupling portion and the second coupling portion have structures that are fixed to each other by magnetic force.

17. The fluid control device according to claim 9, wherein the first coupling portion and the second coupling portion have structures that are fixed to each other by magnetic force.

18. The fluid control device according to claim 1, wherein said plurality of walls further includes a second wall, a third wall, and a fourth wall, said first and second walls facing one another and said third and fourth walls facing one another, wherein each of said third and fourth walls extends between said first and second walls in a direction orthogonal to said first and second walls, wherein said first coupling portion comprises a protrusion projecting outwards from said third wall, and said second coupling portion comprises a recess in said fourth wall, and wherein said second opening is defined by said recess.

19. The fluid control device according to claim 1, wherein said first pump is disposed outside of said housing.

* * * * *